US006164926A

United States Patent [19]

Kawaguchi

[11] Patent Number: 6,164,926

[45] Date of Patent: Dec. 26, 2000

[54] VARIABLE DISPLACEMENT COMPRESSOR

[75] Inventor: Masahiro Kawaguchi, Kariya, Japan

[73] Assignee: Kabushiki Kaisha Toyoda Jidoshokki Seisakusho, Kariya, Japan

[21] Appl. No.: 09/277,697

[22] Filed: Mar. 26, 1999

[30] Foreign Application Priority Data

Apr. 2, 1998 [JP] Japan ..... 10-090060

[51] Int. Cl.[7] ..... F04B 1/26; G05D 13/10

[52] U.S. Cl. ..... 417/222.2; 137/51; 137/56

[58] Field of Search ..... 417/222.2, 222.1, 417/295; 137/51, 53, 56, 57

[56] References Cited

U.S. PATENT DOCUMENTS

| | | | |
|---|---|---|---|
| 2,657,699 | 11/1953 | Barrett et al. | 137/53 |
| 4,285,311 | 8/1981 | Iio | 123/323 |
| 4,606,705 | 8/1986 | Parekh | 417/222.2 |
| 4,872,814 | 10/1989 | Skinner et al. | 417/222.2 |
| 5,071,321 | 12/1991 | Skinner et al. | 417/222.2 |
| 5,362,211 | 11/1994 | Iizuka et al. | 417/222.2 |
| 5,417,552 | 5/1995 | Kayukawa | 417/222.2 |
| 5,842,834 | 12/1998 | Kawaguchi et al. | 417/222.2 |
| 5,842,835 | 12/1998 | Kawaguchi et al. | 417/222.2 |

FOREIGN PATENT DOCUMENTS

| | | |
|---|---|---|
| 0 396 017 A2 | 11/1990 | European Pat. Off. . |
| 0 748936 A1 | 12/1996 | European Pat. Off. . |
| 3603931 A1 | 8/1986 | Germany . |
| 61-134580 | 8/1996 | Japan . |

*Primary Examiner*—Timothy S. Thorpe
*Assistant Examiner*—Michael K. Gray
*Attorney, Agent, or Firm*—Morgan & Finnegan, L.L.P.

[57] ABSTRACT

A variable displacement compressor having a pressurizing passage, which extends through a cylinder block. The pressurizing passage connects a discharge chamber and a crank chamber. A valve is arranged in the pressurizing passage. A drive shaft rotates and produces centrifugal force that causes the valve to open the pressurizing passage. The pressure of the crank chamber is increased when the rotation of the drive shaft is accelerated thereby opening the pressurizing passage with the valve. This moves a swash plate such that its inclination, relative to a plane perpendicular to the drive shaft, decreases. As a result, the compressor shifts from a maximum displacement state to a minimum displacement state, which improves the acceleration performance of an engine connected to the compressor. Furthermore, the displacement of the compressor in the minimum displacement state is 50% of that in the maximum displacement state. This prevents an excessive decrease in the cooling capability of the compressor.

20 Claims, 12 Drawing Sheets

VARIABLE DISPLACEMENT COMPRESSOR

BACKGROUND OF THE INVENTION

The present invention relates to variable displacement compressors employed in automotive air conditioning systems.

A typical variable displacement compressor has a housing that houses a crank chamber and supports a rotatable driving shaft. Cylinder bores extend through a cylinder block, which forms part of the housing. A piston is accommodated in each cylinder bore. A swash plate is supported to rotate integrally with the drive shaft, while inclining in the axial direction. Rotation of the swash plate reciprocates each piston and draws refrigerant gas into the associated cylinder bore, compresses the refrigerant gas, and disharges the compressed refrigerant gas into a discharge chamber. A displacement control valve adjusts the difference between the pressure of the cylinder bores and the pressure of the crank chamber (first differential pressure ΔP1) to alter the inclination of the swash plate with respect to a plane perpendicular to the drive shaft. The stroke of the pistons is changed in accordance with the inclination of the swash plate to vary the displacement of the compressor.

Typically, the variable displacement compressor is connected to an automotive engine by an electromagnetic clutch. The clutch is actuated to connect the engine to the compressor when activating the air conditioning system.

When the inclination of the swash plate is large, that is, when the displacement of the compressor is large, an increase in the engine speed may rotate the drive shaft at a high speed. In such case, the compression load increases in a sudden manner. This increases the product of the pressure between contacting surfaces of moving parts and the velocity of the contacting moving parts (i.e., Pv value). As a result, the life of the moving parts and the compressor is shortened.

Such shortcomings have been overcome by de-actuating the electromagnetic clutch to stop operation of the compressor in accordance with parameters indicating acceleration of the automobile. For example, operation of the compressor is stopped when the engine speed increases, or when the detected engine intake air pressure and acceleration pedal depression exceed predetermined values. However, such de-actuation of the compressor increases fluctuations in the temperature of the air blown through an evaporator, which is connected to the compressor by way of an external refrigerant circuit. As a result, warm air enters the passenger compartment and makes the passenger compartment uncomfortable. Additionally, the shifting of the electromagnetic clutch between actuated and de-actuated states produces shocks.

Compressors that continue operation during acceleration of the vehicle are also known. However, such compressors interfere with acceleration and lower fuel consumption.

Accordingly, U.S. Pat. No. 4,872,814 proposes a variable displacement compressor that overcomes these shortcomings. The compressor has a displacement shifting mechanism that shifts displacement from a maximum state toward a minimum state when the rotating speed becomes too high. As shown in FIG. 18, the displacement shifting mechanism includes a pressurizing passage 101 that connects a crank chamber with a discharge chamber (neither shown). A valve body 102 is attached to a drive shaft 103 by means of springs 105, 106 to rotate integrally with the drive shaft 103. The pressurizing passage 101 has a port 104. As shown by the chain lines in FIG. 18, the valve body 102 moves relative to the drive shaft 103 in a direction parallel to the axis L of the drive shaft 103 and in a direction perpendicular to the axis L. Movement of the valve body 102 in these two directions opens and closes the port 104 to the valve body 102. Under normal conditions, the forces of the springs 105, 106 cause the valve body 102 to close the port 104. The valve body 102 is arranged in a crank pressure region 101*a*, which is located downstream of the port 104 in the pressurizing passage 101.

The valve body 102 includes a weight 102*a*. When the displacement of the compressor is large, if the engine speed N increases and causes the rotating speed of the drive shaft 103 to exceed a predetermined limit value Nc, which is shown in FIG. 19, the centrifugal force applied to the weight 102*a* moves the valve body 102 against the force of the spring 105 in a direction perpendicular to axis L and opens the port 104. When the port 104 is opened, the refrigerant gas in the discharge chamber enters the crank chamber through the pressurizing passage 101 and increases the pressure of the crank chamber. Consequently, the first differential pressure ΔP1 increases and decreases the displacement of the compressor. This decreases compression load and avoids excessive friction of the moving parts.

If the condenser becomes too warm when the displacement of the compressor is large, for example, when cooling of the condenser becomes insufficient, the pressure of the discharge chamber becomes abnormally high. In such case, if the difference between the pressure of the discharge chamber and the pressure of the crank pressure region 101 (second differential pressure ΔP2) exceeds a predetermined limit value ΔPc, the discharge pressure communicated through the port 104 moves the valve body 102 toward the drive shaft 103 against the pressure of the crank pressure region and the force of the spring 106 to open the port 104. Thus, the refrigerant gas in the discharge chamber enters the crank chamber through the pressurizing passage 101 and increases the pressure of the crank chamber. This decreases the displacement of the compressor. As a result, the compression load decreases and reduces friction in moving parts.

The refrigerant gas in the discharge chamber is drawn into the crank chamber to increase the pressure of the crank chamber and decrease the displacement of the compressor when the rotating speed N of the drive shaft 103 exceeds a predetermined limit value Nc or when the second differential pressure ΔP2 exceeds the predetermined limit value ΔPc.

However, this compressor has the shortcomings described below.

(1) The shifting of the displacement from a maximum state toward a minimum state improves the acceleration performance of the vehicle and fuel efficiency. However, there is a large displacement difference between the maximum displacement and the minimum displacement. For example, if the displacement is 100% in the maximum displacement state, the displacement is 1% to 10% in the minimum displacement state. Therefore, a relatively long time is necessary to return the compressor to the maximum displacement state from the minimum displacement state. This results in insufficient cooling of the passenger compartment. Furthermore, shifting of the displacement from the maximum state to the minimum state and then back to the maximum state causes fluctuations in the torque applied to the engine. This may lower the driving performance of the vehicle.

(2) The valve body attached to the drive shaft 103 moves when receiving centrifugal force from the weight 102*a*. This unbalances the drive shaft 103, which produces vibration and torque fluctuation.

(3) When the compressor displacement is large but the rotating speed N of the drive shaft 103 and the second differential pressure ΔP2 are both below their limit values Nc, ΔPc, the displacement is not decreased. In FIG. 19, the cross-hatched zone S represents a range in which the rotating speed N of the drive shaft 103 and the second differential pressure ΔP2 are both close to but below their limit values Nc, ΔPc. To stop operation of the compressor in the cross-hatched zone S and prevent undesirable wear of the moving parts, the limit values Nc, ΔPc must both be lowered to Nc', ΔPc', respectively, as shown in FIG. 19. The load applied to the compressor is excessive when the rotating speed N and the second differential pressure ΔP2 are in the cross-hatched zone S. On the other hand, if the rotating speed N or the second differential pressure ΔP2 were to exceed the associated lower limit value Nc', ΔPc' without entering the cross-hatched zone S, the friction load would be acceptable. Nevertheless, the displacement would be decreased. In other words, the displacement would be unnecessarily decreased, which would interfere with the cooling process.

SUMMARY OF THE INVENTION

Accordingly, it is an objective of the present invention to provide a variable displacement compressor that performs smooth compression and operates the compressor efficiently.

To achieve the above objective, the present invention provides a variable displacement compressor including a drive shaft rotated about its axis and a compression mechanism for drawing in and compressing gas in accordance with the rotation of the drive shaft. The compression mechanism includes a drive plate supported on the drive shaft. The drive plate inclines between a maximum inclination position, at which the displacement of the compressor is maximum, and a minimum inclination position, at which the compressor displacement is minimum. A crank chamber houses part of the compression mechanism. The gas flows into and out of the crank chamber to vary the displacement in accordance with the pressure of the gas in the crank chamber. The inclination of the drive plate is decreased as the pressure of the crank chamber increases. The compressor further includes a suction pressure region, which is exposed to the gas drawn into the compressor by the compression mechanism, a discharge pressure region, which is exposed to the gas compressed by the compression mechanism, a first passage that increases the pressure of the crank chamber by permitting the flow of the gas from the discharge pressure region to the crank chamber, a second passage that decreases the pressure of the crank chamber by permitting the flow of the gas from the crank chamber to the suction pressure region, and a valve arranged to open or close a port, which is in either the first passage or the second passage. The valve adjusts the opened area of the port to increase the pressure of the crank chamber when the rotating speed of the drive shaft exceeds a predetermined value. A mechanism regulates the minimum inclination position of the drive plate such that the minimum displacement is about 30% to 60% of the maximum displacement.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS (First Embodiment)

Figure 1:
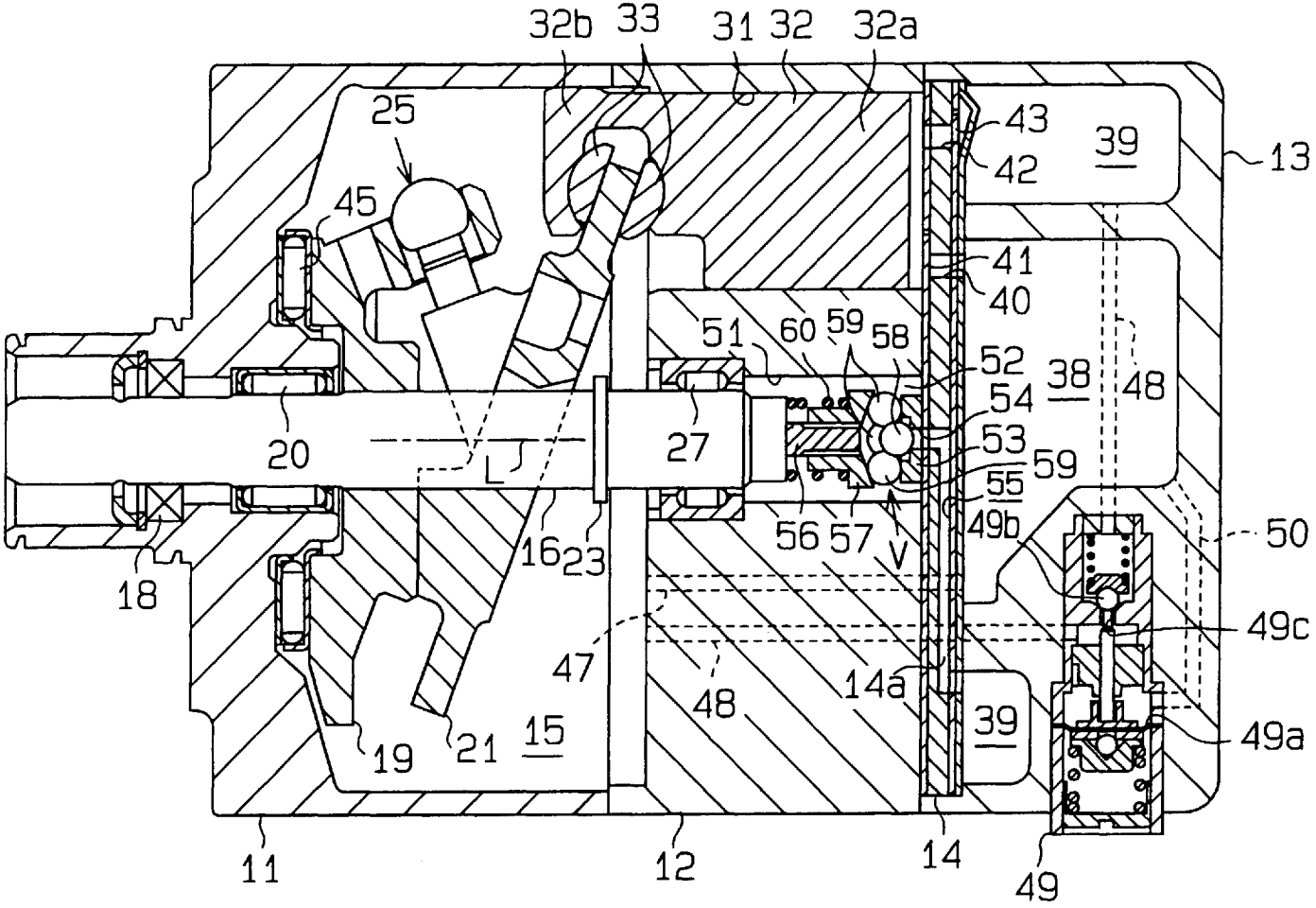
FIG. 1 is a cross-sectional view showing a variable displacement compressor according to a first embodiment of the present invention with a swash plate located at a maximum inclination position.

A variable displacement compressor according to a first embodiment of the present invention will now be described with reference to FIGS. 1 to 6. As shown in FIG. 1, a front housing 11 is fixed to the front end of a cylinder block 12, while a rear housing 13 is fixed to the rear end of the cylinder block 12 with a valve plate 14 arranged in between. A compressor housing is defined by the front housing 11, the cylinder block 12, and the rear housing 13.

The rear housing 13 houses a suction chamber 38, which defines a suction pressure region, and a discharge chamber 39, which defines a discharge pressure region. The valve plate 14 includes suction ports 40, suction flaps 41, discharge ports 42, and discharge flaps 43. A crank chamber 15 is defined in the front housing 11 in front of the cylinder block 12. A drive shaft 16 extends through the crank chamber 15 between the front housing 11 and the cylinder block 12. The drive shaft 16 is rotatably supported by radial bearings 20 and 27.

A rotor 19 is fixed to the drive shaft 16. A drive plate, or swash plate 21, which functions as a cam plate, is fitted to the drive shaft 16. The swash plate 21 is supported such that it inclines as it slides along the drive shaft 16. A hinge mechanism 25 connects the swash plate 21 to the rotor 19. Thus, the hinge mechanism 25 rotates the swash plate 21 integrally with the drive shaft 16 while guiding the inclining motion of the swash plate 21.

Figure 2:
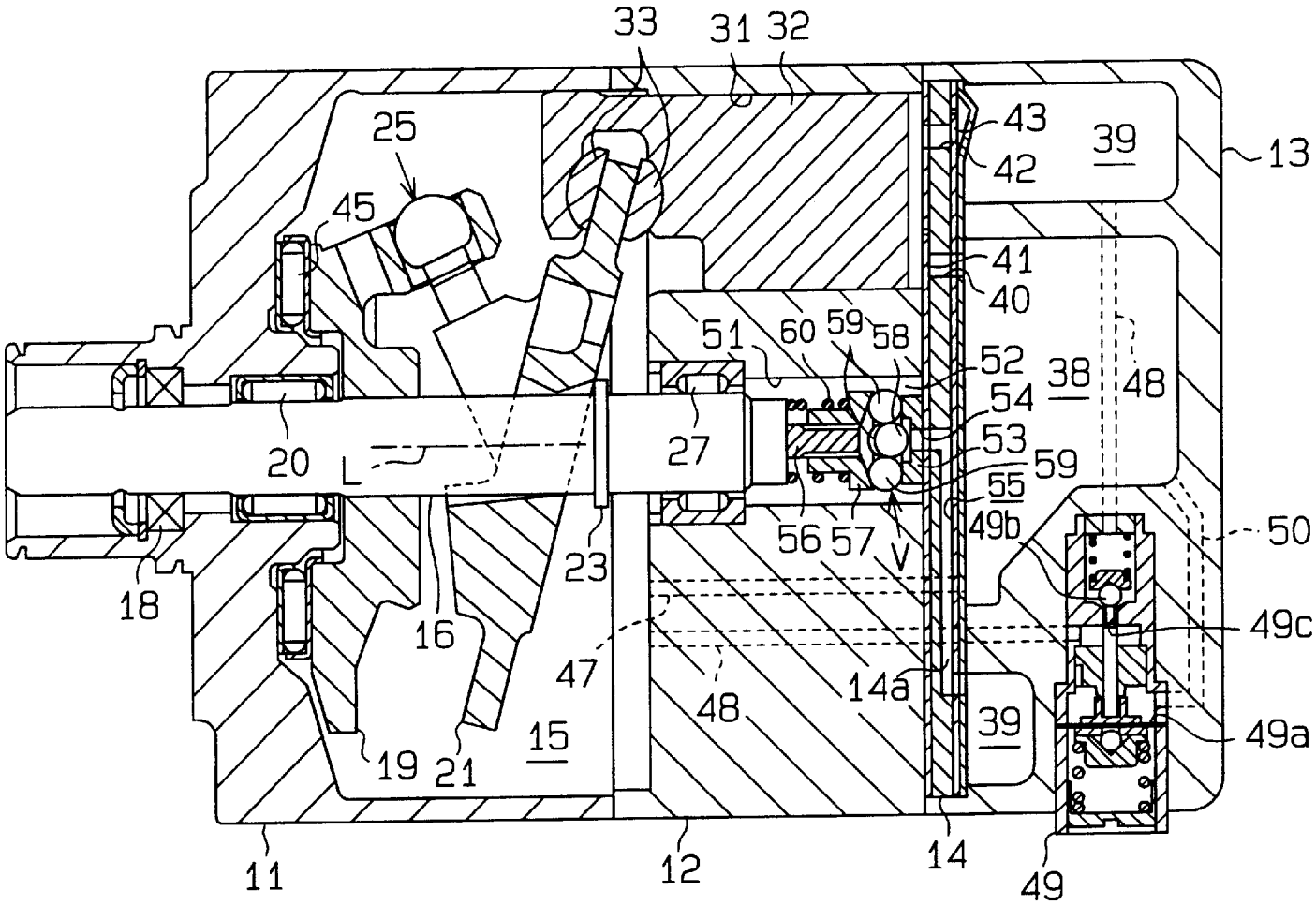
FIG. 2 is a cross-sectional view showing the compressor of FIG. 1 with the swash plate located at a minimum inclination position.

When the central portion of the swash plate 21 moves toward the cylinder block 12, the inclination of the swash plate 21, relative to a plane perpendicular to the axis L of the drive shaft, decreases. A snap ring 23 is fitted on the drive shaft 16 between the swash plate 21 and the cylinder block 12. Abutment of the swash plate 21 against the snap ring 23 restricts further movement of the swash plate 21. As shown in FIG. 2, the swash plate 21 is located at a minimum inclination position and the displacement of the compressor is thus minimum when the swash plate 21 contacts the snap ring 23. An increase in the inclination of the swash plate 21 is permitted until the swash plate 21 abuts against the rotor 19. In this state, as shown in FIG. 1, the swash plate 21 is located at a maximum inclination position and the displacement is thus maximum. The minimum inclination position of the swash plate 21 is set so that the displacement is 50% of that when the swash plate 21 is located at the maximum displacement position. Thus, the snap ring 23 and the rotor 19 serve as stoppers that limit the movement of the swash plate 21.

Cylinder bores 31 extend through the cylinder block 12. A piston 32 is accommodated in each cylinder bore. Each piston 32 has a head 32*a* and an opposing skirt 32*b*. Each skirt 32*b* is coupled to the peripheral portion of the swash plate 21 by a pair of shoes 33. A compression reaction force produced by the compression motion of the pistons 32 is received by the front housing 11 by way of the shoes 33, the swash plate 21, the hinge mechanism 25, the rotor 19, and a thrust bearing 45.

A bleeding passage 47 extends between the crank chamber 15 and the suction chamber 38 through the cylinder block 12 and the valve plate 14. The bleeding passage 47 is located between a pair of adjacent cylinder bores 31.

A supply passage 48 and a pressurizing passage 55 independently connect the discharge chamber 39 and the crank chamber 15. A displacement control valve 49 is arranged in the supply passage 48. The control valve 49 has a diaphragm 49*a*, a valve body 49*b*, and a valve hole 49*c*. The diaphragm 49*a* adjusts the opening size of the valve hole 49*c* by regulating the position of the valve body 49*b*. Suction pressure Ps is communicated through a pressure sensing passage 50 and is applied to the diaphragm 49*a* to adjust the opening size of the valve hole 49*c* with the valve body 49*b*.

The control valve 49 adjusts the amount of refrigerant gas drawn into the crank chamber 15 from the discharge chamber 39 through the supply passage 48 to control the first differential pressure ΔP1, which is the difference between the crank chamber pressure Pc acting on the skirt side of the pistons 32, and the pressure Pb of the cylinder bores 31 acting on the head side of the pistons 32. The inclination of the swash plate 21 is varied in accordance with the first differential pressure ΔP1. This changes the stroke of the pistons 32 and varies the displacement.

As shown in FIGS. 1 to 4, a central bore 51 extends through the cylinder block 12. A conduit 14*a* extends through the valve plate 14 between the discharge chamber 39 and the central bore 51. The pressurizing passage 55 includes the conduit 14*a*, the central bore 51, and the spaces formed in the radial bearing 27. The high-pressure refrigerant gas in the discharge chamber 39 is sent into the crank chamber 15 through the pressurizing passage 55 to increase the crank chamber pressure Pc. This increases the first differential pressure ΔP1 and decreases the displacement.

A valve chamber 52 is defined in the central bore 51. A valve V is accommodated in the valve chamber 52 to selectively open and close the pressurizing passage 55. The valve V opens the pressurizing passage 55 when the rotating speed N of the drive shaft 16 exceeds a predetermined limit value Nc and closes the pressurizing passage 55 when the speed N is equal to or lower than the limit value Nc.

The valve V includes a valve seat 53, which serves as a fixed guide. The valve seat 53 is fixed to the valve plate 14 in the valve chamber 52. A valve port 54, which is aligned with the drive shaft axis L, extends through the valve seat 53. The valve chamber 52 is connected to the discharge chamber 39 through the valve port 54 and the conduit 14*a*.

The valve seat 53 has a fixed guide surface 53*a*, which faces a rear end face 16*a* of the drive shaft 16. The fixed guide surface 53*a* is flat and annular. The valve port 54 extends through the center of the fixed guide surface 53*a*. The inner portion of the fixed guide surface 53*a* is stepped toward the valve plate 14.

A connecting rod 56 projects from the rear end face 16*a* of the drive shaft 16 along the axis L. The connecting rod 56 is coupled to a guide 57, which serves as a rotating member. Splines 56*a* extend axially along the connecting rod 56, while splines 57*b* extend axially along the guide 57. The splines 56*a*, 57*b* mesh with one another to rotate the guide 57 integrally with the drive shaft 16 while permitting axial movement of the guide 57. The guide 57 has a rotating guide surface 57*a* coaxial to the fixed guide surface 53*a* of the valve seat 53. The rotated guide surface 57*a* is tapered like the surface of a truncated cone. The greater the radius of a point on the rotated guide surface 57*a*, the closer that point is to the fixed guide surface 53*a*.

A spherical valve body 58 is accommodated in the valve chamber 52. The valve body 58 moves along axis L to open or close the valve port 54. That is, the valve body 58 opens or closes the pressurizing passage 55 in the valve chamber 52, which is included in the crank chamber pressure region. A plurality of equally spaced orbiting elements, or orbiting balls 59, are arranged between the fixed guide surface 53*a* and the rotated guide surface 57*a*. The centers of the balls 59 are located on a circle, the center of which is the axis L. The angular spacing between any given ball 59 and the ball 59 furthest from the given ball 59 is 90° or greater. The balls 59 and the valve body 58 are identical. Thus, the diameter and material of the balls 59 and the valve body 58 are the same.

A coil spring 60 is arranged between the rear end face 16*a* of the drive shaft 16 and a stepped portion 57*c* of the rotated guide 57 to urge the rotated guide 57 toward the valve seat 53. Thus, the balls 59 are held between the planar fixed guide surface 53*a* and the conical rotated guide surface 57*a*. The conical surface 57*a* forces the balls 59 toward axis L until the balls 59 contact the valve body 58. Thus, pressure is applied to the outer surface of the valve body 58 from several locations by the balls 59. The pressure is directed toward the center point 01 of the valve body 58. The center point 01 is located along axis L at a position that is rearward from contact points 02, which are the points of contact between the balls 59 and the valve body 58. Thus, the valve body 58 is urged to abut against the valve seat 53 to close the valve port 54.

The operation of the compressor will now be described. The drive shaft 16 is rotated by an external drive source such as an automotive engine. When the drive shaft 16 is rotated, the rotor 19 and the hinge mechanism 25 rotate the swash plate 21 integrally with the drive shaft 16. The rotation of the swash plate 21 is converted to linear reciprocation of the pistons 32 by means of the shoes 33. The reciprocation of each piston 32 causes the refrigerant gas in the suction chamber 38 to be drawn into the associated cylinder bore 31 through the suction port 40 and suction flap 41. The refrigerant gas is then compressed to a predetermined pressure value and discharged from the cylinder bore 31 into the discharge chamber 39 through the discharge port 42 and the discharge flap 43.

When the compressor is not operating, the pressures of the suction chamber 38, the discharge chamber 39, and the crank chamber 15 are substantially balanced. In this state, the valve hole 49*c* is closed by the valve body 49*b* in the control valve 49. When operation of the compressor commences, the reciprocation of the pistons 32 compresses refrigerant gas and discharges the compressed gas into the discharge chamber 39.

The cooling load is great when the temperature in the passenger compartment is high. In such state, the suction pressure Ps in the suction chamber 38 is high. Thus, the first differential pressure ΔP1 (the difference between the pressure Pc of the crank chamber 15 and the pressure Pb of the cylinder bores 31) is small. This holds the swash plate 21 at the maximum inclination position, as shown in FIG. 1, and lengthens the stroke of the pistons 32 to operate the compressor at its maximum displacement (100% displacement). In this state, the high suction pressure Ps communicated through the pressure sensing passage 50 acts on the diaphragm 49*a* and keeps the valve hole 49*c* closed by the valve body 49*b*. Thus, the supply passage 48 is closed. The high-pressure refrigerant gas in the discharge chamber 39 therefore does not flow into the crank chamber 15.

During the compression and discharge stroke of each piston 32, in which the piston 32 moves from the bottom dead center position to the top dead center position, blow-by gas flows into the crank chamber 15 through the space between the outer surface of the piston 32 and the wall of the associated cylinder bore 31. The blow-by gas in the crank chamber 15 is returned to the suction chamber 38 through the bleeding passage 47. Thus, the crank chamber pressure Pc is maintained at a satisfactory level regardless of the blow-by gas, which enables the compressor to continue operation in the maximum displacement state.

When the temperature of the passenger compartment decreases, the cooling load decreases. This decreases the suction pressure Ps of the suction chamber 38. The low suction pressure Ps communicated through the pressure sensing passage 50 acts on the diaphragm 49*a* of the control valve 49. Thus, the diaphragm 49*a* deforms in accordance with the suction pressure Ps. This moves the valve body 49*b* in a direction opening the valve hole 49*c*, which increases the size of the supply passage 48. Hence, the high-pressure refrigerant gas in the discharge chamber 39 flows into the crank chamber 15 through the supply passage 48. The flow rate of the refrigerant gas sent to the crank chamber 15 changes in accordance with the size of the valve hole 49*c*. As a result, the pressure Pc of the crank chamber 15 increases thereby increasing the first differential pressure ΔP1. The swash plate 21 moves toward the minimum inclination position in accordance with the first differential pressure ΔP1. This shortens the stroke of the pistons 32 and decreases the displacement.

When the temperature of the passenger compartment further decreases, the cooling load approaches a null state. This further decreases the suction pressure Ps of the suction chamber 38 and maximizes the size of the valve hole 49*c* of the control valve 49. In this state, the high-pressure refrigerant gas in the discharge chamber 39 is sent to the crank chamber 15 through the supply passage 48. This further increases the first differential pressure ΔP1 and moves the swash plate 21 to the minimum inclination position, as shown in the state of FIG. 2. This shortens the stroke of the pistons 32 and operates the compressor in a minimum displacement state (50% displacement).

During operation of the compressor, if the temperature of the passenger compartment increases, the cooling load increases. This increases the suction pressure Ps of the suction chamber 38. The increased suction pressure Ps communicated through the pressure sensing passage 50 acts on the diaphragm 49*a* of the control valve 49. Thus, the diaphragm 49*a* deforms in accordance with the suction pressure Ps. This moves the valve body 49*b* in a direction closing the valve hole 49*c* and causes the control valve 49 to decrease the size of the supply passage 48. Hence, the flow rate of the refrigerant gas sent to the crank chamber 15 from the discharge chamber 39 through the supply passage 48 decreases. As a result, the pressure Pc of the crank chamber 15 decreases thereby decreasing the first differential pressure ΔP1. The swash plate 21 moves toward the maximum inclination position in accordance with the first differential pressure ΔP1. This lengthens the stroke of the pistons 32 and increases the displacement.

When the temperature of the passenger compartment and the cooling load further increases, the suction pressure Ps of the suction chamber 38 increases. The high suction pressure Ps, communicated through the pressure sensing passage 50, acts on the diaphragm 49*a* of the control valve 49 and closes the valve hole 49*c*, or the supply passage 48. This stops the flow of high-pressure refrigerant gas from the discharge chamber 39 to the crank chamber 15. The refrigerant gas in the crank chamber 15 then bleeds into the suction chamber 38 through the bleeding passage 47. This decreases the pressure Pc of the crank chamber 15 such that the difference between the crank chamber pressure Pc and the suction pressure Ps becomes small. Thus, the first differential pressure ΔP1 becomes small, which moves the swash plate 21 to the maximum inclination position. This lengthens the stroke of the pistons 32 and operates the compressor in a maximum displacement state (100% displacement).

Accordingly, the variable displacement compressor alters the pressure Pc of the crank chamber 15 with the control valve 49 in accordance with the cooling load, or suction pressure Ps, to ultimately maintain the suction pressure Ps at a constant suction pressure Ps.

Figure 3:
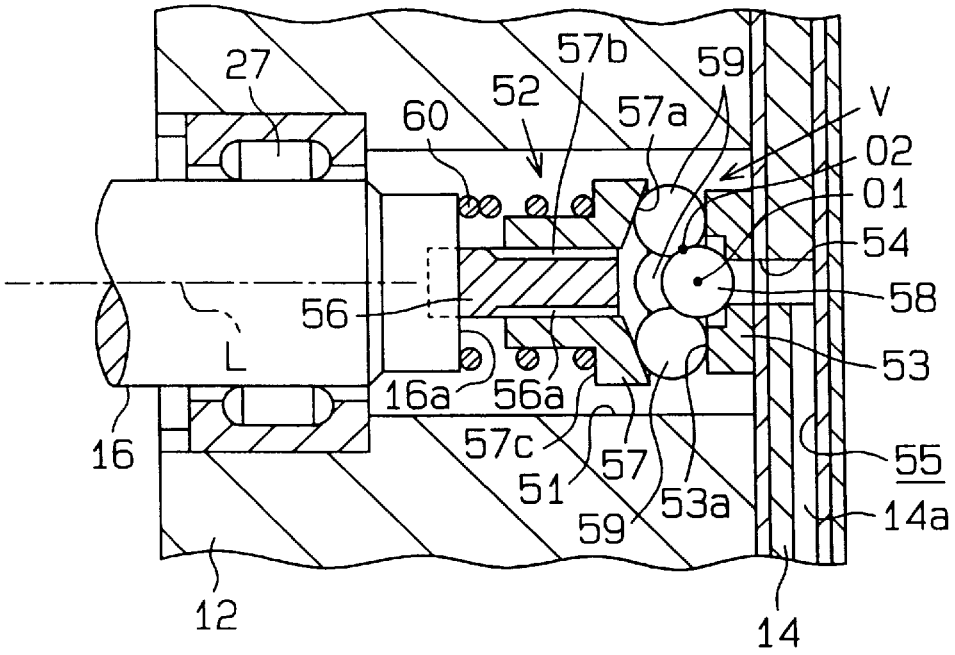
FIG. 3 is a partial enlarged cross-sectional view showing the compressor of FIG. 1 in a state in which a valve port is closed by a valve body.

As shown in FIGS. 1 and 3, the valve body 58 closes the valve port 54 and the pressurizing passage 55 when the drive shaft 16 is rotated under normal conditions.

During operation of the compressor, the guide 57 rotates integrally with the drive shaft 16. Thus, the rotated guide surface 57*a* rotates relative to the fixed guide surface 53*a* of the seat 53. Since the balls 59 are held between the guide surfaces 53*a*, 57*a*, the rotation of the guide 57 rolls the balls 59 about the axis L of the drive shaft 16. Centrifugal force acts on the rolling balls 59 in a direction that increases the orbital radius of the balls 59.

If the rotating speed N of the drive shaft 16 is low, the centrifugal force applied to the balls 59 is small. In such case, the force of the coil spring 60 urges the balls 59 toward the drive shaft axis L. The balls 59 abut against the valve body 58. This restricts movement of the balls 59 toward axis L and stabilizes the rolling motion of the balls 59 about axis L.

The conical surface of the rotated guide surface 57*a* is tapered relative to axis L such as to counter the centrifugal force acting of the balls 59. Thus, the guide 57 receives a component force that urges the guide 57 in a direction countering the force of the spring 60 when centrifugal force acts on the balls 59. This offsets the force of the spring 60 and decreases the force applied to the valve body 58 that closes the valve port 54 compared to that when the drive shaft 16 is stationary. The closing force decreases as the rotating speed of the drive shaft 16 increases.

As the operation of the compressor continues, the pressure of the discharge chamber 39 Pd becomes higher than the pressure Pc of the valve chamber 52 (the crank chamber pressure Pc and the pressure of the valve chamber 52 are the same). Accordingly, the difference between the pressure Pd of the discharge chamber 39 and the pressure Pc of the valve chamber 52, or the second differential pressure ΔP2, acts on the valve body 58 in a direction opening the valve port 54 during operation of the compressor. The force becomes greater if the rotating speed N of the drive shaft 16 increases, which causes an increase in the pressure Pd of the discharge chamber 39, or if the pressure Pd of the discharge chamber 39 is increased by insufficient cooling by the condenser (not shown).

Figure 6:
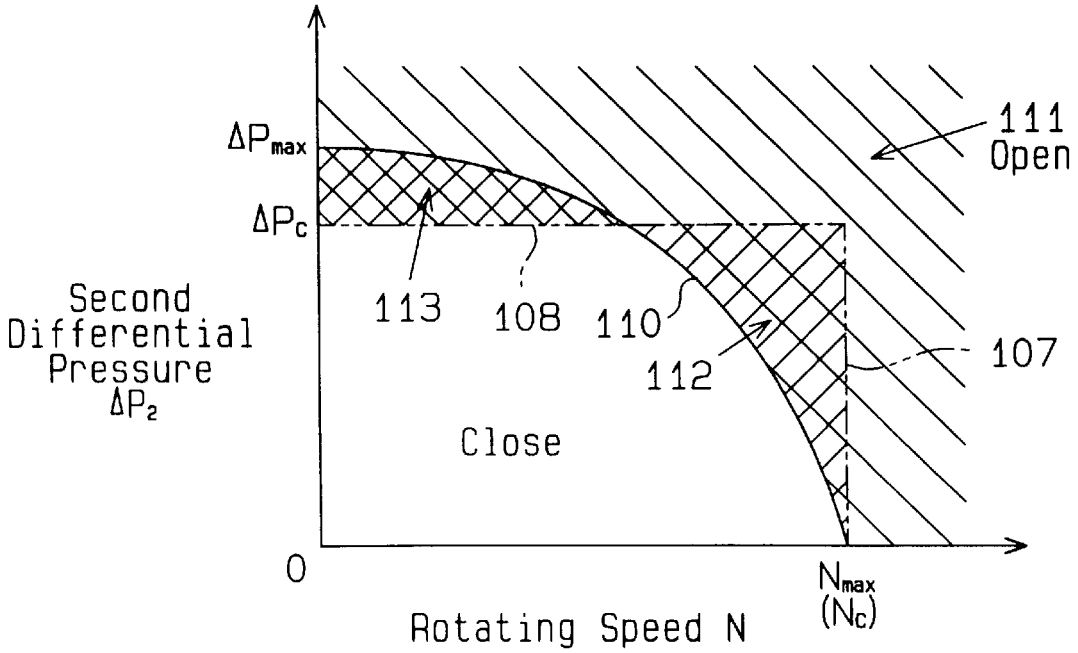
FIG. 6 is a graph showing the operating characteristics of the valve body of the compressor of FIG. 1.

Accordingly, during operation of the compressor, the opening of the pressurizing passage 55 by the valve body 58 occurs in accordance with fluctuations in the rotating speed N of the drive shaft 16 and fluctuations in the second differential pressure ΔP2. This is due to the changing equilibrium between the force that opens the valve port 54 and the force that closes the valve port 54. FIG. 6 is a graph plotting predetermined limit values Nx of the drive shaft rotating speed N, which is represented by the horizontal axis, and predetermined limit values ΔPx of the second differential pressure ΔP2, which is represented by the vertical axis. In other words, the level of the second differential pressure ΔP2 required to open the valve chamber port 54 decreases as the rotating speed of the drive shaft 16 becomes higher. On the other hand, the rotating speed N of the drive shaft 16 that causes the valve body 58 to open the valve chamber port 54 becomes lower as the second differential pressure ΔP2 increases (i.e., as the pressure of the discharge chamber 39 increases). As shown in the graph of FIG. 6, the second differential pressure ΔP2 that opens the valve V when the rotating speed N is null is defined as $\Delta P_{max}$, while the rotating speed N that opens the valve V when the second differential pressure ΔP2 is null is defined as $N_{max}$. Limit values for determining whether the valve body 58 should be opened are plotted along a limit value curve 110, which connects $\Delta P_{max}$ and $N_{max}$. Zone 111, indicated by slanted lines (which includes the area 112 marked by rectangles), represents the range in which the valve V is opened. The zone on the other side of the curve 110 (which includes the area 113 marked by squares) represents the range in which the valve V is closed.

When the valve body 58 opens the valve port 54, gas from the discharge chamber 39 is drawn into the crank chamber 15 through the pressurizing passage 55. This increases the pressure of the crank chamber 15, increases the first differential pressure ΔP1, and decreases the displacement. The decreased displacement decreases the compression load of the compressor and avoids early deterioration of the moving parts, such as the bearings 20, 27, 45, the seal 18, the swash plate 21, the shoes 33, and the pistons 32.

Figure 4:
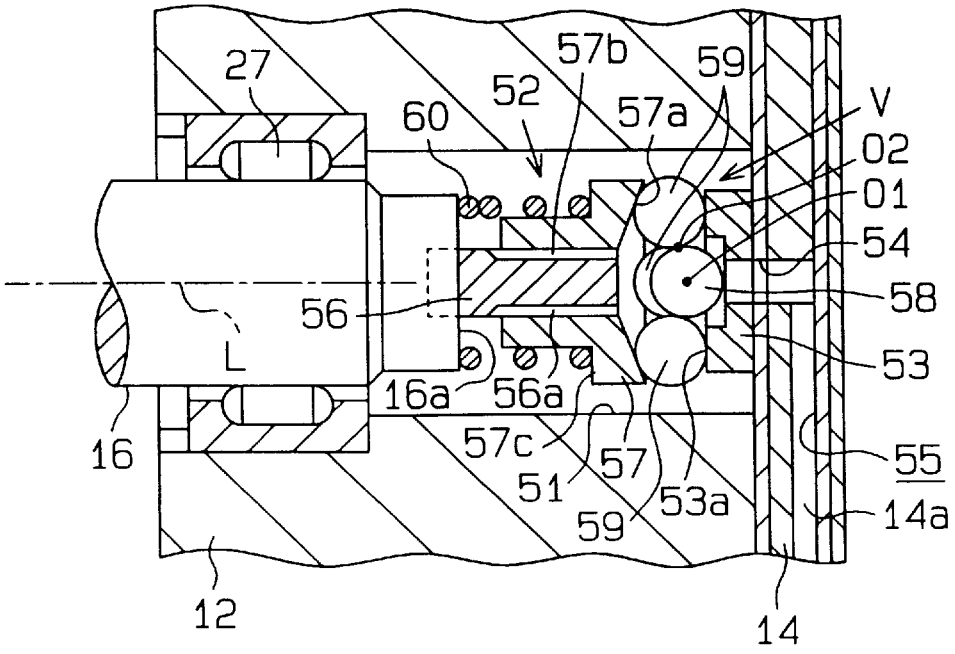
FIG. 4 is a partial enlarged cross-sectional view showing the compressor of FIG. 1 in a state in which the valve port is opened by the valve body.
Figure 5:
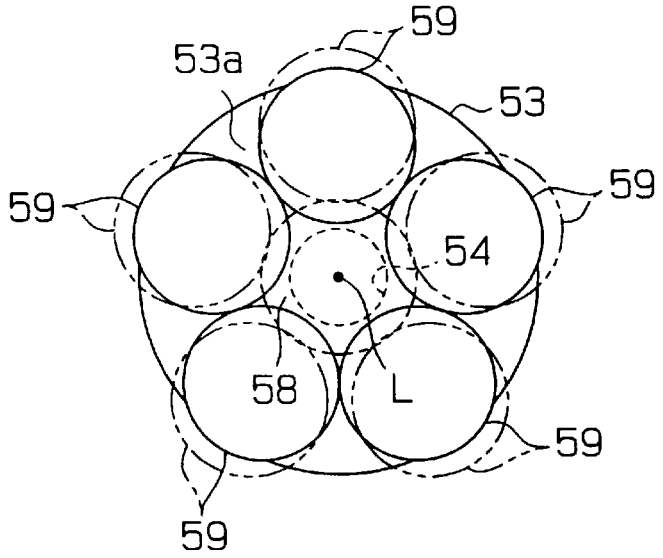
FIG. 5 is a front view showing orbiting balls and the valve body of the compressor of FIG. 1.

If the rotating speed N of the drive shaft 16 increases when the valve V is opened, such as in the state shown in FIG. 4, an increase in centrifugal force urges the balls 59 outward from the guide surfaces 53*a*, 57*a*. However, the wall of the central bore 51 restricts the orbiting radius of the balls 59. Thus, the balls 59 remain between the guide surfaces 53*a*, 57*a*.

When the rotating speed N of the drive shaft 16 and the second differential pressure ΔP2 fall below the limits set by the limit value curve 110 (FIG. 6) when the valve port 54 is opened, the force applied to the valve body 58 in a direction opening the valve port 54 becomes less than the force applied to the valve body 58 in a direction closing the valve port 54. Accordingly, the force of the spring 60 moves the rotated guide 57 toward the seat 53 and narrows the distance between the guide surfaces 57*a*, 53*a*. This moves the balls 59 inward along the conical rotated guide surface 57*a* such that the orbiting radius of the balls 59 decreases and forces the valve body 58 toward the seat 53 to close the valve port 54. When the valve port 54 is closed, the delivery of gas from the discharge chamber 39 to the crank chamber 15 through the pressurizing passage 55 stops. In this state, displacement is varied by the control valve 49, which controls the size of the supply passage 48.

The advantages of the first embodiment will now be described.

(1) In the first embodiment, the valve V is arranged in the pressurizing passage 55, which connects the discharge chamber 39 and the crank chamber 15, to open the pressurizing passage 55 when the rotating speed N of the drive shaft 16 exceeds the limit defined by the limit value curve 110 of FIG. 6. If the rotating speed N exceeds the limit value when the displacement of the compressor is large, the valve V opens the pressurizing passage 55 to permit the flow of the high-pressure refrigerant gas in the discharge chamber 39 to the crank chamber 15, which increases the pressure of the crank chamber 15. This decreases the displacement of the compressor, reduces the compression load, and decreases the pressure applied to moving components that are subject to friction. As a result, the Pv value of the moving components decreases, which extends the life of the compressor.

(2) When the valve V opens the pressurizing passage 55, the compressor shifts from a maximum displacement state (100% displacement) to a minimum displacement state (50% displacement). In this compressor, if the displacement is 100% in the maximum displacement state, the displacement is 50% in the minimum displacement state, whereas the displacement in the minimum displacement state is 1% to 10% in the prior art compressor. Thus, the displacement is prevented from becoming excessively low. This keeps the passenger compartment cool and comfortable. Furthermore, since torque fluctuations do not occur, the driving performance is improved.

(3) The valve body 58 moves away from the valve port 54 to open the pressurizing passage 54 when the rotating speed N of the drive shaft 16 exceeds the limit value $N_{max}$. Accordingly, the compression load is decreased by the simple valve V, which uses centrifugal force.

(4) The valve V is arranged between the rear end of the drive shaft 16 and the valve plate 14. Thus, the valve V is arranged using the open space in the vicinity of the rear end of the drive shaft 16, or the central bore 51, efficiently. This avoids interference between the valve V and other compressor components. Furthermore, the compressor need not be enlarged to install the valve V.

(5) The balls 59, which receive centrifugal force during rotation of the drive shaft 16, are arranged about the axis L and equally spaced from one another. The balanced arrangement of the balls 59 permits smooth compression motion, eliminates vibration, and maintains the driving comfort of the vehicle.

(6) As shown by the limit value curve 110 in the graph of FIG. 6, the valve body 58 opens the valve port 54 at a smaller second differential pressure ΔP2 as the drive shaft rotating speed N becomes higher. The valve body 58 opens the valve port 54 at a lower drive shaft rotating speed N as the second differential pressure ΔP2 becomes higher. In the compressor of U.S. Pat. No. 4,872,814, the limit value Nc of the drive shaft rotating speed N, at which the valve is opened, is constant, as depicted by vertical line 107. However, in this embodiment, the rotating speed N that determines the opening timing of the valve V in accordance with the second differential pressure ΔP2 varies as shown by the limit value curve 110. Furthermore, in the compressor of U.S. Pat. No. 4,872,814, the limit value ΔPc of the second differential pressure ΔP2, at which the valve is opened, is constant, as depicted by horizontal line 108. However, in this embodiment, the limit value of the second differential ΔP2 varies in accordance with the drive shaft rotating speed N.

Accordingly, the compressor is prevented from having a large displacement when the drive shaft rotating speed N and the discharge chamber pressure Pd are both high. In other words, if the second differential pressure ΔP2 and the drive shaft rotating speed N are included in triangular zone 112, as shown in the graph of FIG. 6, operation of the compressor is avoided.

Furthermore, in the prior art, the limit value ΔPc of the second differential pressure ΔP2 was required to be set at a low value even at low drive shaft rotating speeds N. However, in this embodiment, the second differential pressure ΔP2 at which the valve V opens is higher at lower rotating speeds N. Thus, if the point representing the second differential pressure ΔP2 and the rotating speed N is between the horizontal line 108 and the limit value curve 110, as shown in the graph of FIG. 6, the valve V is not opened. In other words, the valve V does not open when the second differential pressure ΔP2 is low. This prevents an unnecessary displacement decrease when the compressor is being driven at low speeds. Accordingly, the compressor responds appropriately to demands for cooling while protecting itself.

(5) The balls 59 roll in any direction. Thus, the balls 59 roll smoothly along the guide surfaces 53*a*, 57*a* during rotation of the drive shaft 16. This easily changes the orbiting radius of the balls 59 about axis L. Furthermore, the balls 59 have no directional restrictions and are thus easily installed during assembly of the compressor.

(6) The valve body 58 is also spherical. Thus, the valve body 58 is also easily installed.

(7) The valve body 58 and the balls 59 are identical spherical bodies. Thus, the valve body 58 and the balls 59 are interchangeable. This facilitates assembly of the compressor.

(Second Embodiment)

Figure 7:
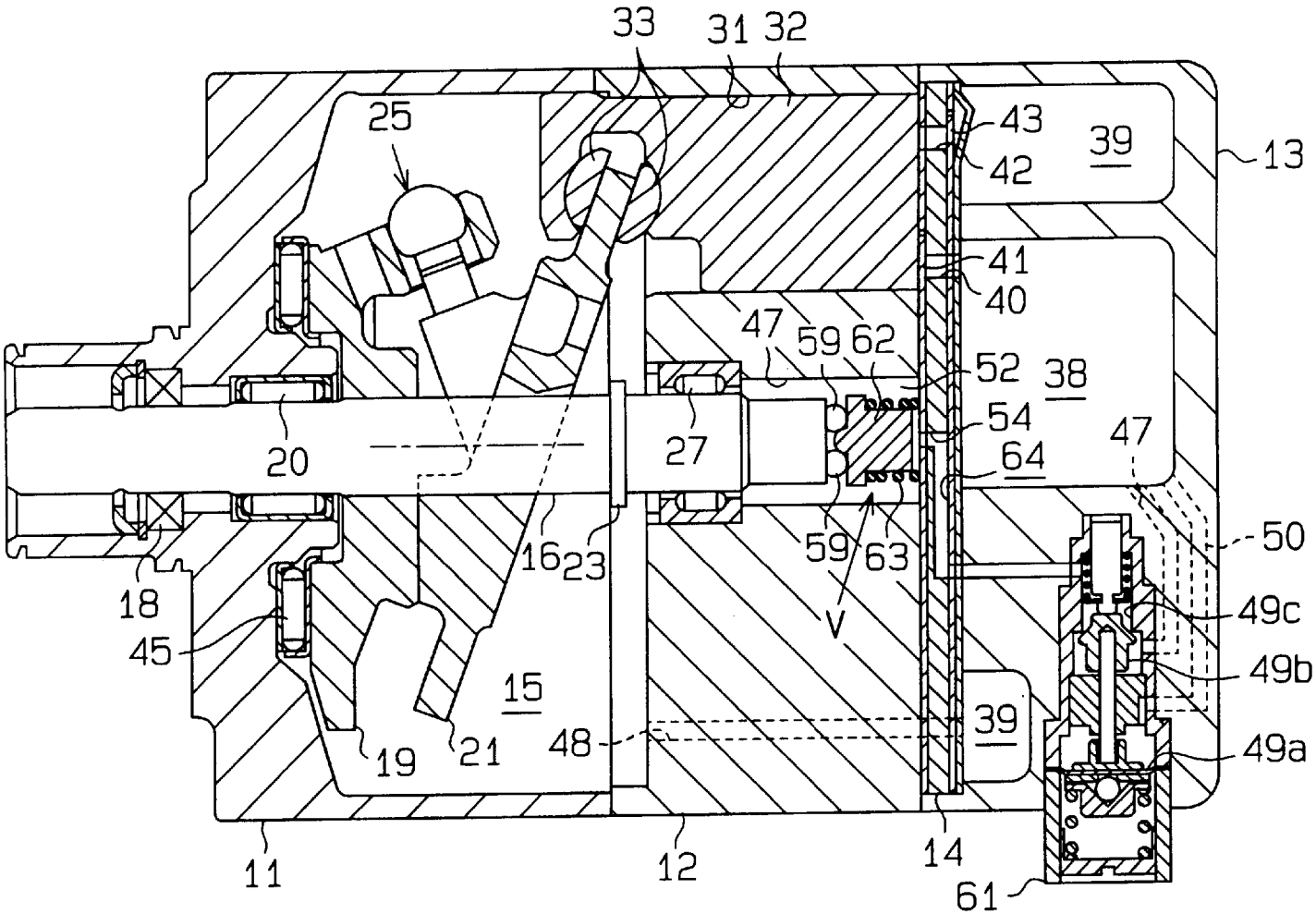
FIG. 7 is a cross-sectional view showing a variable displacement compressor according to a second embodiment of the present invention.
Figure 8:
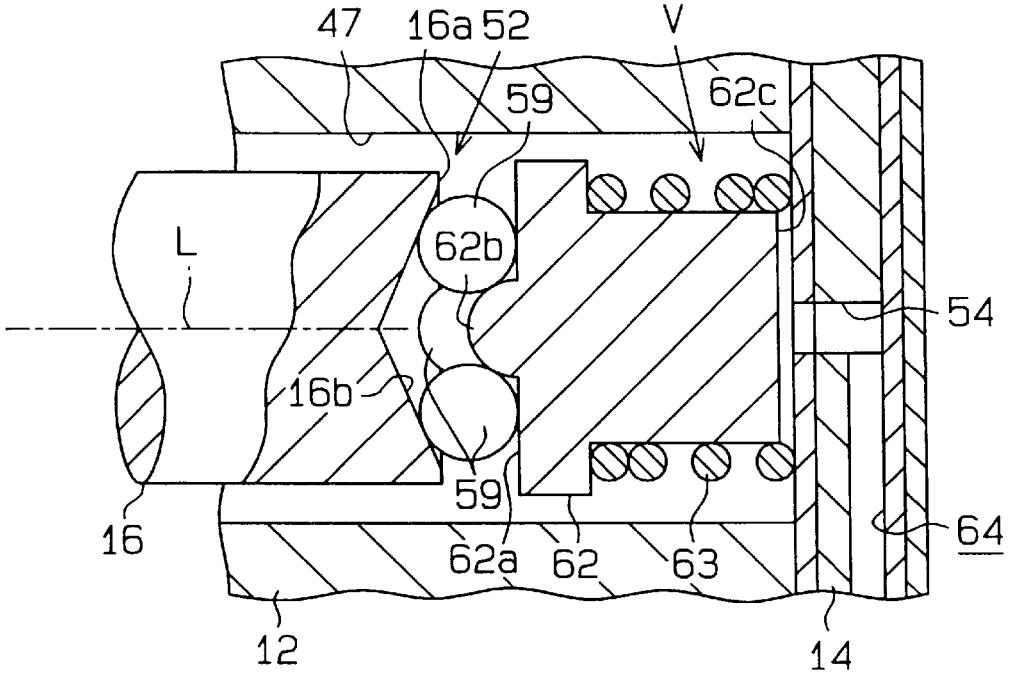
FIG. 8 is a partial enlarged cross-sectional view showing the compressor of FIG. 7 in a state in which a valve port is opened by a valve body.
Figure 9:
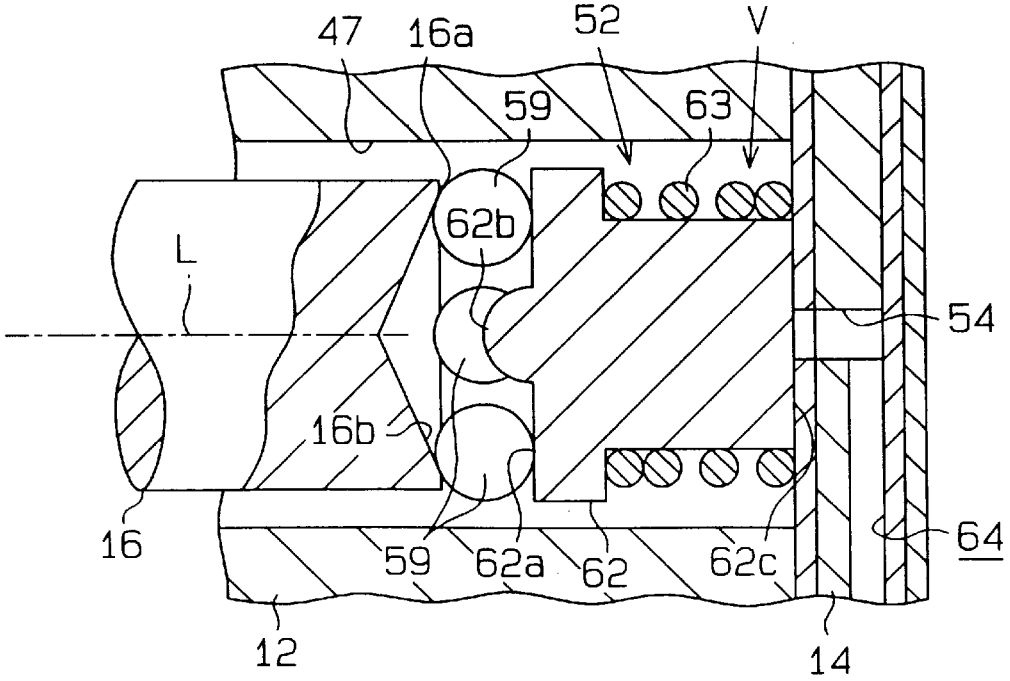
FIG. 9 is a partial enlarged cross-sectional view showing the compressor of FIG. 7 in a state in which the valve port is closed by the valve body.

A second embodiment according to the present invention will now be described with reference to FIGS. 7 to 9. As shown in FIG. 7, a displacement control valve 61 is arranged in a bleeding passage 47. The control valve 61 increases the size of the bleeding passage 47 when the suction pressure becomes higher than a predetermined value. Thus, gas in the crank chamber 15 is released into the suction chamber 38 through the bleeding passage 47. The decrease in the pressure of the crank chamber 15 moves the swash plate 21 toward the maximum inclination position and lengthens the stroke of the pistons 32. If the suction pressure becomes lower than the predetermined value, the control valve 61 decreases the size of the bleeding passage 47. Thus, the refrigerant gas in the discharge chamber 39 is drawn into the crank chamber 15 through the supply passage 48. This increases the pressure of the crank chamber 15, moves the swash plate 21 toward the minimum inclination position, and shortens the stroke of the pistons 32.

The bleeding passage 47 also serves as a pressure releasing passage in which the valve V is arranged. As shown in FIG. 8, a valve chamber 52 is defined between the crank chamber 15 and the control valve 61 in the bleeding passage. Spaces formed in the radial bearing 27 connect the crank chamber 15 with the valve chamber 52. The supply passage 48 extends through the cylinder block 12 to continuously permit the flow of gas from the discharge chamber 39 to the crank chamber 15.

A valve body 62, which serves as a fixed guide, is accommodated in the valve chamber 52 and supported by a coil spring 63, which serves as an urging means. The valve body 62 moves axially to selectively open and close a valve port 54. The force of the coil spring 63 urges the valve body 62 to a position spaced from the valve port 54. The valve chamber 52 is connected to the suction chamber 38 through the valve port 54, and a conduit 64, which extends through the valve plate 14 and the rear housing 13.

The valve body 62 has a fixed guide surface 62*a*, which is annular and defined on the surface facing the rear end face 16*a* of the drive shaft 16. A spherical projection 62*b*, coaxial with axis L, projects from the front side of the valve body 62. A seal surface 62*c* is defined on the rear side of the valve body 62.

A conical rotated guide surface 16*b*, facing the fixed guide surface 62*a*, is defined on the rear end face 16*a* of the drive shaft 16 about axis L. The drive shaft 16 serves as a rotated guide. The force of the coil spring 63 holds the balls 59 between the fixed guide surface 62*a* and the rotated guide surface 16*b*. The conical rotated guide surface 16*b* guides the balls 59 toward the axis L until they contact the spherical projection 62*b*.

During operation of the compressor, the rotation of the drive shaft 16 applies centrifugal force to the balls 59 and increases the orbiting radius of the balls 59. As the orbiting radius of the balls 59 increase and causes the balls 59 to move outward along the conical rotated guide surface 16*b*, the balls 59 push the valve body 62 toward the valve port 54 against the force of the spring 63.

The valve V is arranged such that it opens the bleeding passage 47 under normal situations. Thus, differential pressure does not act on the valve body 62. Accordingly, the valve V is closed when the drive shaft rotating speed N reaches a fixed limit value Nc independently of the differential pressure.

When the vehicle is accelerated such that the rotating speed N exceeds the fixed limit value Nc, the seal surface 62*c* of the valve body 62 abuts against the valve plate 14 and closes the valve port 54. As the valve body 62 closes the valve port 54, gas from the crank chamber 15 stops escaping into the suction chamber 38. Accordingly, the high-pressure refrigerant gas in the discharge chamber 39 continues to enter the crank chamber 15 through the supply passage 48, which increases the pressure of the crank chamber 15 and decreases the displacement. That is, the displacement is shifted from a maximum state (100% displacement) to a minimum state (50% displacement). As a result, the load of the compressor decreases. This avoids early deterioration of compressor components caused by friction and improves the driving comfort of the vehicle.

If the rotating speed N falls below the limit value Nc when the valve port 54 is closed, the centrifugal force applied to the balls 59 weakens and decreases the orbiting radius of the balls 59. Thus, the force of the spring 63 moves the valve body 62 toward the drive shaft 16 and opens the valve port 54. In this state, the displacement is varied in accordance with the size of the bleeding passage 47 opened by the control valve 61.

In addition to advantages (1) to (3) of the first embodiment, the second embodiment has the advantages described below.

(1) In the second embodiment, the valve V is arranged in the bleeding passage 47, which connects the crank chamber 15 to the suction chamber 38. Thus, an exclusive pressure releasing passage is not necessary. This simplifies the structure of the compressor. In other words, the valve body 62 opens the valve port 54 under normal conditions (i.e., when the rotating speed N of the drive shaft 16 is lower than the limit value Nc) and does not interfere with the adjustment of the bleeding passage 47 by the control valve 61.

(2) When the balls 59 roll and rotate about axis L, the valve body 62 follows the balls 59 and rotates. The spring 63 permits rotation of the valve body 62. However, when the valve body 62 opens the valve port 54, as shown in FIG. 8, the valve body 62 is spaced from the valve plate 14. Thus, there is no resistance, which would interfere with smooth rotation of the drive shaft 16, between the valve body 62 and the valve plate 14. In other words, the valve body 62 and the valve plate 14 do not contact each other during normal operation, which allows the drive shaft 16 to rotate smoothly. This leads to smooth compression motion and maintains driving comfort.

(3) The seal surface 62*c* of the valve body 62 abuts against the valve plate 14 to close the valve port 54. In this state, the valve port 54 is closed to prevent leakage of refrigerant gas. This decreases displacement as desired.

(4) The valve body 62 serves as the fixed guide. This decreases the number of components and simplifies the structure of the compressor.

(5) The spherical projection of the valve body 62 restricts movement of the balls 59 toward axis L when the rotating speed N of the drive shaft 16 is low.

(6) The drive shaft 16 includes the rotated guide 16*b*, which is defined on the rear end face 16*a* of the drive shaft 16. Thus, coupling components for coupling the rotated guide to the drive shaft 16 are not required. This further simplifies the structure of the compressor.

(Third Embodiment)

Figure 10:
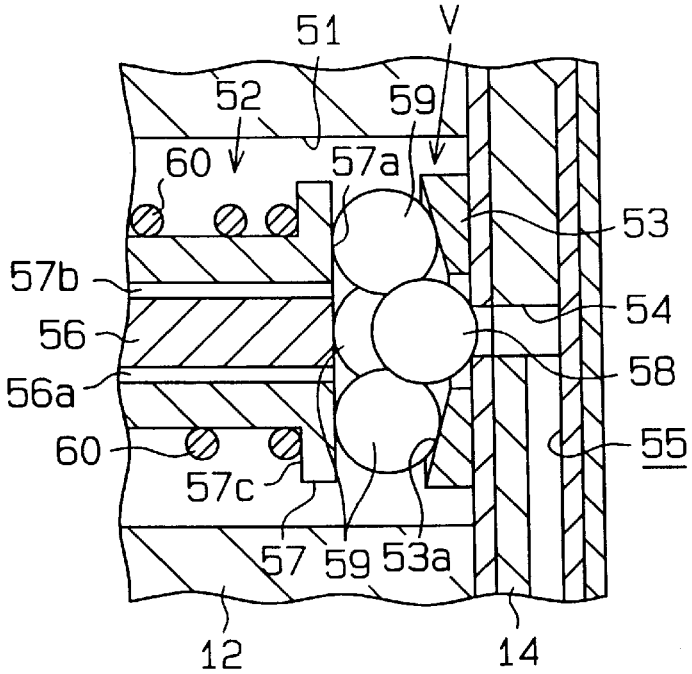
FIG. 10 is a partial cross-sectional view showing a valve port closed by a valve body in a variable displacement compressor according to a third embodiment of the present invention.

A third embodiment according to the present invention will now be described with reference to FIG. 10. In this embodiment, the rotated guide surface 57*a* is flat, while the fixed guide surface 53*a* of the seat 53 is conical. The rotated guide surface 57*a* moves in a direction perpendicular to the axis L when the drive shaft 16 vibrates slightly during rotation. Thus, the balls 59 keep orbiting about the same center point (axis L). Accordingly, accurate orbiting of the balls 59 about axis L stabilizes the opening and closing of the valve port 54 with the valve body 58.

(Fourth Embodiment)

Figure 11:
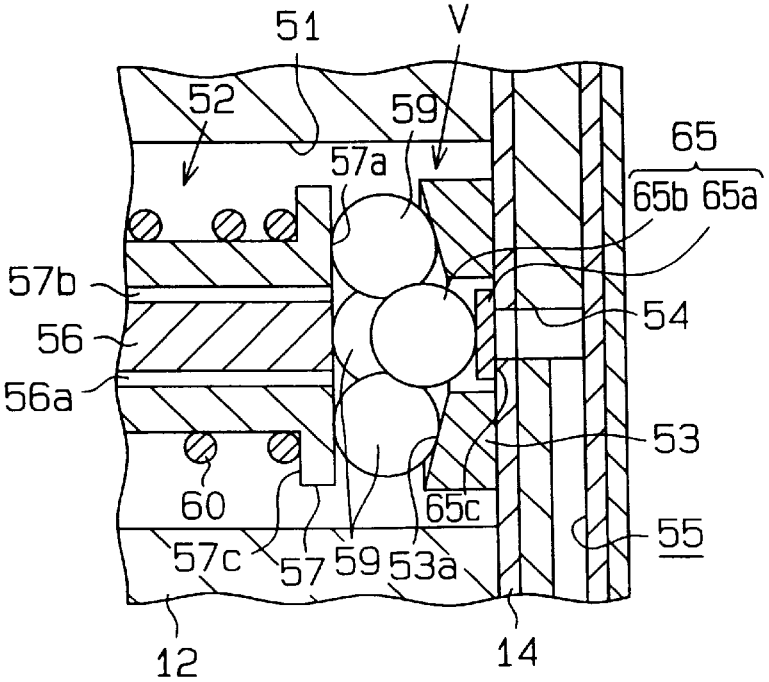
FIG. 11 is a partial cross-sectional view showing a valve port closed by a valve body in a variable displacement compressor according to a fourth embodiment of the present invention.

A fourth embodiment according to the present invention will now be described with reference to FIG. 11. In this embodiment, a two part valve 65 is used instead of the single valve body 58. The valve 65 includes a plate 65*a*, which opens and closes the valve port chamber 54, and a sphere 65*b*, which is arranged between the plate 65*a* and the balls 59. The plate 65*a* has a seal surface 65*c*, which contacts the valve plate 14 to close the valve port 54.

The fourth embodiment has the advantages described below.

(1) When the rotation of the drive shaft 16 orbits the balls 59 about axis L with the valve port 54 closed by the valve body 65, the sphere 65*b* follows the orbiting of the balls 59 and rotates about axis L. However, the sphere 65*b* and the circular plate 65*a* are in point contact with each other. Thus, the plate 65*a* does not follow the rotation of the sphere 65*b*. Accordingly, forces that hinder smooth rotation of the drive shaft 16 are not produced between the circular plate 65*a* and the valve plate 14.

(2) The seal surface 65*c* of the circular plate 65 abuts against the valve plate 14 and closes the valve port 54. Therefore, the valve port 54 is securely closed under normal operating conditions (when the point representing the rotating speed N of the drive shaft 16 and the second differential pressure $\Delta P2$ is lower than the limit value curve 110, shown in FIG. 6). This prevents gas from the discharge chamber from escaping into the crank chamber 15 through the pressurizing passage 55. Therefore, the displacement is accurately controlled by the control valve 49.

(Fifth Embodiment)

Figure 12:
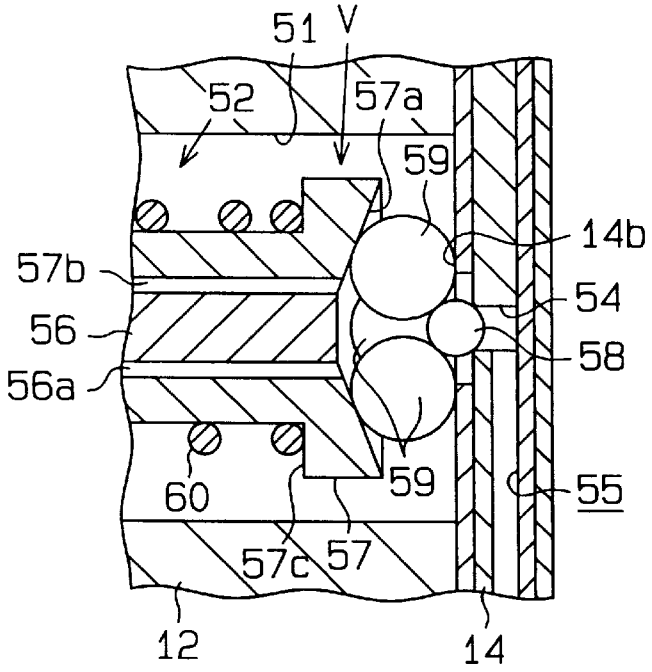
FIG. 12 is a partial cross-sectional view showing a valve port closed by a valve body in a variable displacement compressor according to a fifth embodiment of the present invention.

A fifth embodiment according to the present invention will now be described with reference to FIG. 12. In this embodiment, the size (diameter) of the valve body 58 differs from that of the orbiting balls 59. Furthermore, the seat 53 is eliminated in this embodiment. A valve port 54 is defined in the valve plate 14 at a position corresponding to the valve chamber 52. A fixed guide surface 14*b* is defined about the valve port 54 on the valve plate 14. In other words, the valve plate 14 serves as a fixed guide. This decreases the number of compressor components and simplifies the structure of the compressor.

(Sixth Embodiment)

Figure 13:
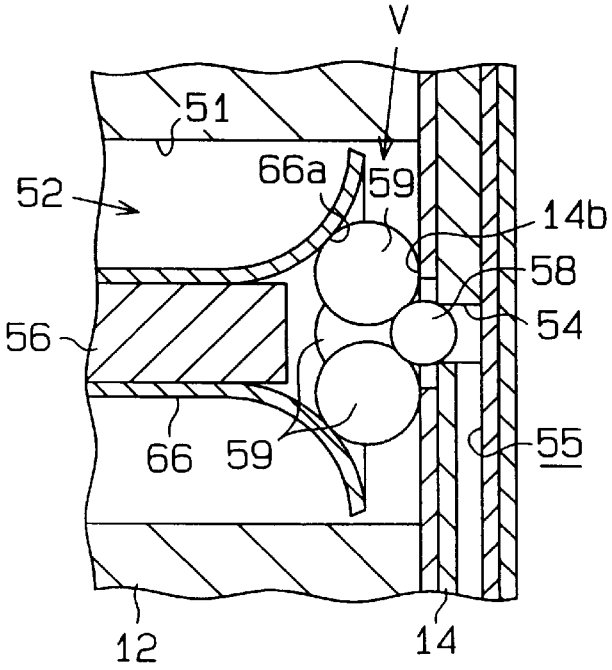
FIG. 13 is a partial cross-sectional view showing a valve port closed by a valve body in a variable displacement compressor according to a sixth embodiment of the present invention.
Figure 14:
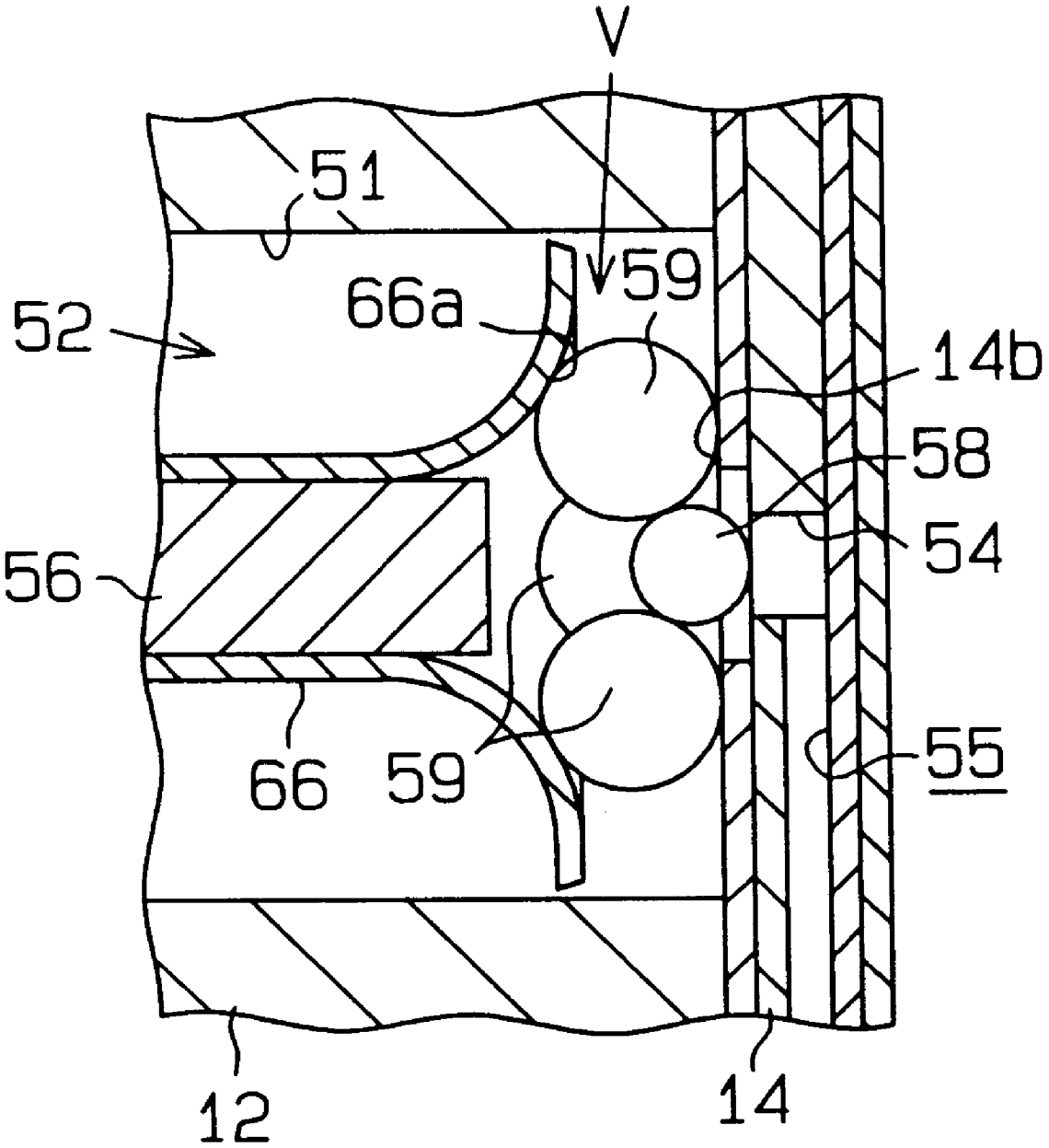
FIG. 14 is a partial cross-sectional view showing the valve port opened by the valve body in the compressor of FIG. 13.

A sixth embodiment according to the present invention will now be described with reference to FIGS. 13 and 14. In this embodiment, the valve plate 14 serves as a fixed guide as in the fifth embodiment. The rotated guide 66 is generally conical (trumpet-shaped) and opens toward the valve plate 14. The rotated guide 66 is fixed to the connecting rod 56. An annular rotated guide surface 66*a* is defined on the conical inner surface of the rotated guide 66 about the axis L facing the valve plate 14. The rotated guide 66 is made of a synthetic resin and is elastic. Elastic deformation of the rotated guide 66 increases the diameter of the rotated guide 66. Alternatively, the rotated guide 66 may be made of a thin metal material.

The rotated guide surface 66*a* of the rotated guide 66 is pressed against the balls 59. Thus, the elastic deformation of the rotated guide 66 occurs. This holds the balls 59 between the fixed guide surface 41*b* and the rotated guide surface 66*a*. The conical rotated guide surface 66*a* forces the balls 59 toward axis L until the balls 59 contact the valve body 58. This causes valve body 58 to abut against valve plate 14 and close the valve port 54. In other words, the rotated guide 66 serves as an urging member in this embodiment.

During acceleration of the vehicle, if the rotating speed N of the drive shaft 16 exceeds the limit value curve 110, the large centrifugal force applied to the balls 59 increases the orbiting diameter of the ball 59. This deforms and widens the rear side of the rotated guide 66 to separate the guide surface 66*a* from the guide surface 14*b*. Therefore, the force applied to the valve body 58 in the direction opening the valve port 54 becomes greater than the force applied to the valve body 58 in the direction closing the valve port 54. This moves the valve body 58 toward the drive shaft 16 and opens the valve port 54.

During normal operation of the compressor (i.e., when the rotating speed N is lower than the limit value curve 110), if the second differential pressure ΔP2 exceeds the limit value curve 110, the force applied to the valve body 58 in the direction that opens the valve port 54 becomes greater than the force applied to the valve body 58 in the direction that closes the valve port 54. This forces the valve body 58 toward the drive shaft 16 and opens the valve port 54.

If the point representing the rotating speed N and the second differential pressure ΔP2 falls below the limit value curve 110 when the valve port 54 is opened, the force applied to the valve body 58 in the direction opening the valve port 54 becomes lower than the force applied to the valve body 58 in the direction closing the valve port 54. Thus, the diameter of the rear side of the rotated guide 66 decreases causing the guide 66 to return to its original position. As a result, the distance between the guide surfaces 66*a*, 14*b* decreases. This decreases the orbiting radius of the balls 59 and closes the valve port 54 with the valve body 58.

In this embodiment, the elastic rotated guide 66 also serves as an urging member. This simplifies the structure of the compressor.

(Seventh Embodiment)

A seventh embodiment according to the present invention will now be described with reference to FIGS. 15 and 16. In this embodiment, the rotated guide 57 is similar to that of the first embodiment. A fixed guide is defined on the valve plate 14 in the same manner as the fifth embodiment. An accommodating chamber 68, which is similar to the valve chamber 52 of the second embodiment, is located in the bleeding passage 47 between the displacement control valve 61 and the suction chamber 38. A valve port 69, which is coaxial to the shaft axis L, extends through the valve plate 14. The suction chamber 38 and the accommodation chamber 68 are connected to each other through the valve port 69.

The valve body 67 includes a main portion 67*a*, which is arranged in the suction chamber 38, a contact portion 67*b*, which is arranged in the accommodating chamber 68, and a rod 67*c*, which extends through the valve port 69 and integrally connects the main portion 67*a* to the contact portion 67*b*. The main portion 67*a* is spherical. The contact portion 67*b* has a conical surface 67*d*, the diameter of which decreases at locations closer to the drive shaft 16. A coil spring 70 is arranged in the suction chamber 38 to urge the main portion 67*a* in a direction closing the valve port 69. Contact between the conical surface 67*d* and the orbiting balls 59 restricts movement of the contact portion 67 toward the drive shaft 16. Thus, the main portion 67*a* keeps the valve port 69 opened under normal conditions, as shown in FIG. 15.

Figure 15:
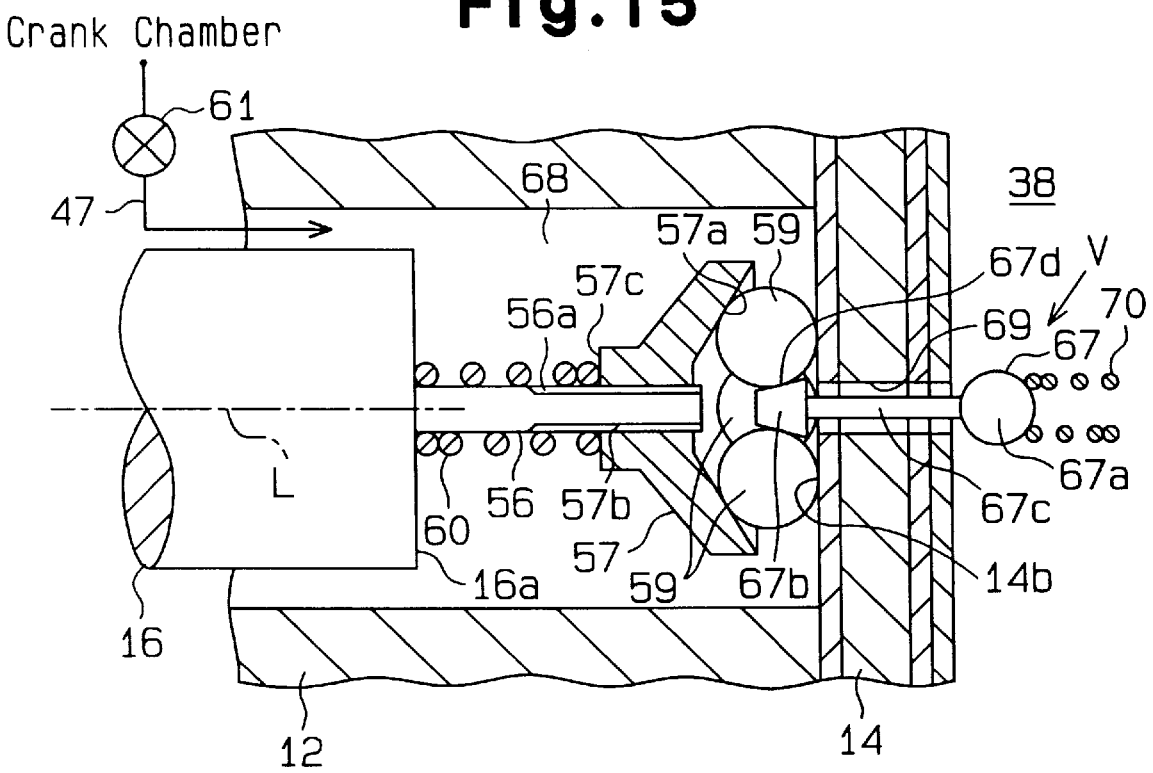
FIG. 15 is a partial cross-sectional view showing a valve port opened by a valve body in a variable displacement compressor according to a seventh embodiment of the present invention.
Figure 16:
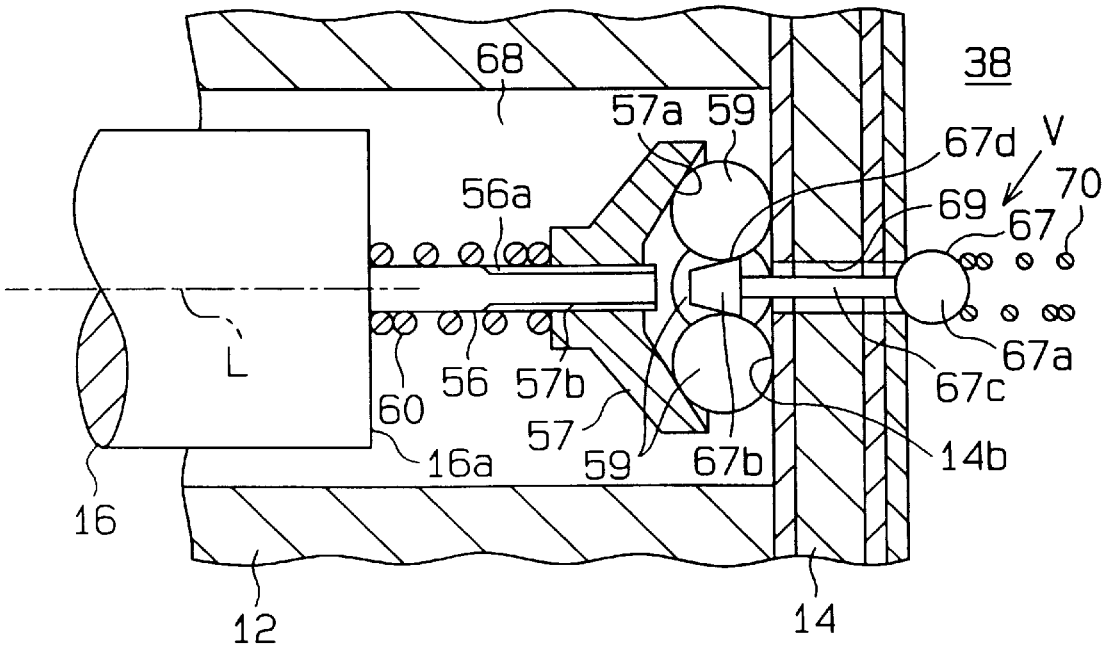
FIG. 16 is a partial cross-sectional view showing the valve port closed by the valve body in the compressor of FIG. 14.

If the rotating speed N of the drive shaft 16 exceeds a fixed limit value Nc in the state of FIG. 15, the centrifugal force applied to the balls 59 moves the balls 59 in a direction increasing the orbiting radius of the balls 59. This causes the balls 59 to permit movement of the rotated guide 57 toward the drive shaft 16 against the force of the spring 60 and separates the guide surface 57*a* from the guide surface 14*b*. Consequently, the force of the spring 70 moves the main and contact portions 67*a*, 67*b* of the valve body 67 toward the drive shaft 16 until the main portion 67*a* abuts against the valve plate 14 and closes the valve port 69, as shown in FIG. 16.

If the rotating speed N of the drive shaft 16 falls below the fixed limit value Nc when the valve port 69 is closed, the centrifugal force applied to the balls 59 weakens. Accordingly, the force of the spring 60 moves the rotated guide 57 toward the valve plate 14 such that the guide surface 57*a* approaches the guide surface 14*b*. This decreases the orbiting radius of the balls 59. The decreased orbiting radius moves the contact portion 67*b* toward the valve plate 14. This moves the main portion 67*a* against the force of the spring 70 and opens the valve port 69.

Advantages (1) to (5) and (7) of the first embodiment and advantages (1) and (2) of the second embodiment are also obtained in the seventh embodiment.

(Eighth Embodiment)

Figure 17:
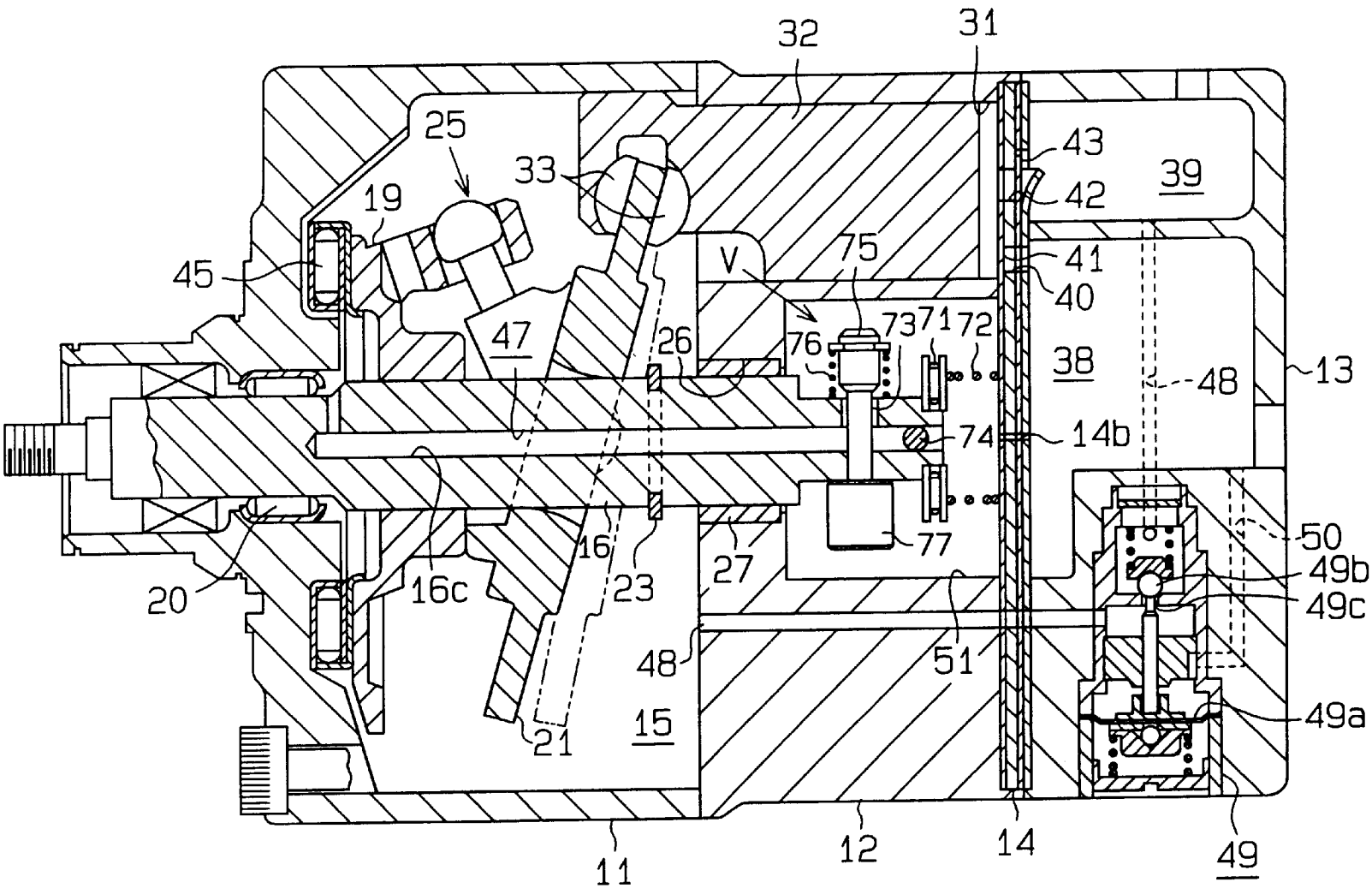
FIG. 17 is a cross-sectional view showing a variable displacement compressor according to an eighth embodiment of the present invention.
Figure 18:
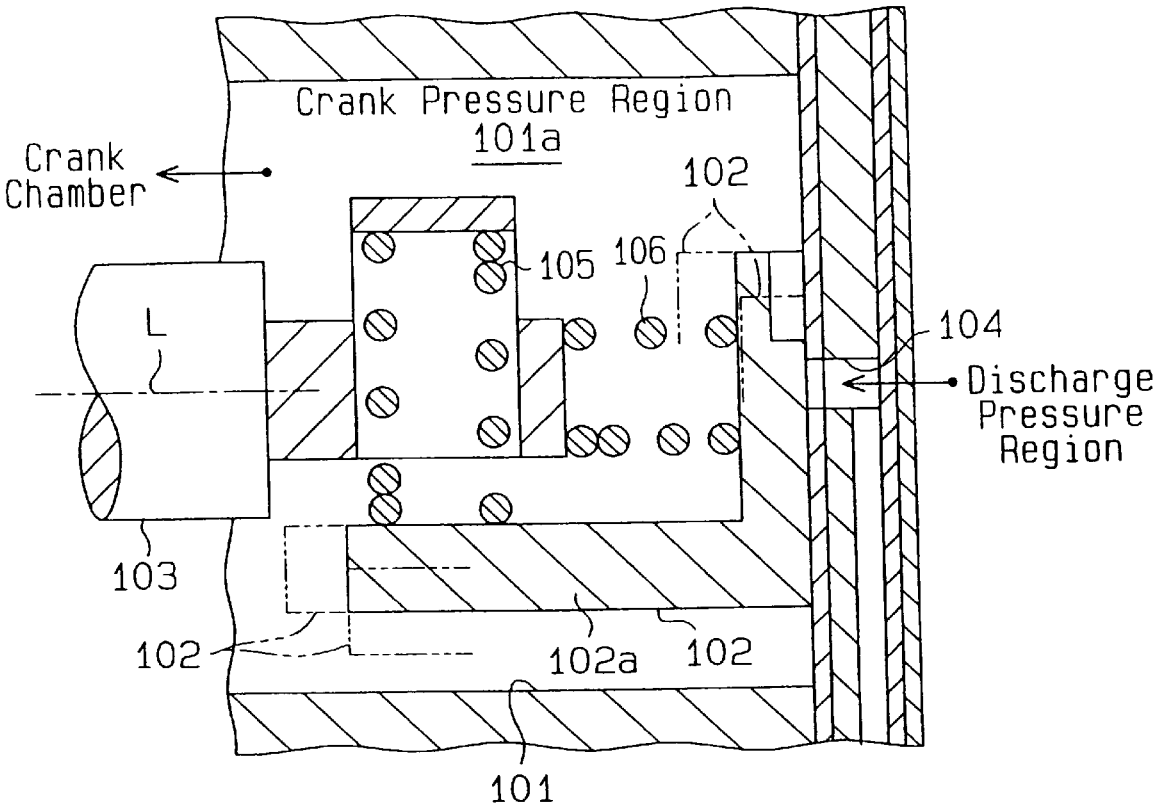
Fig.18(Prior Art)
FIG. 18 is a partial cross-sectional view showing a prior art variable displacement compressor.
Figure 19:
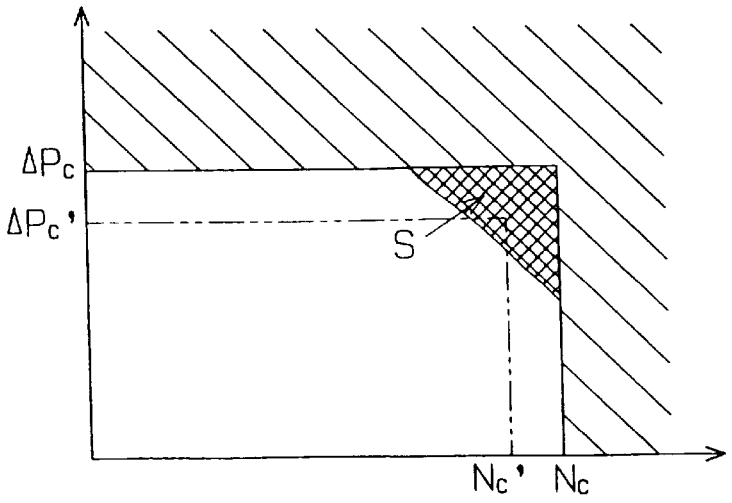
Fig.19(Prior Art)
FIG. 19 is a graph showing the characteristics of a valve body employed in the prior art compressor of FIG. 18.

An eighth embodiment according to the present invention will now be described with reference to FIG. 17. To avoid a redundant description, like or same reference numerals are given to those components that are the same as the corresponding components of the first embodiment.

A central bore 26 extends through the center of the cylinder block 12 to receive the drive shaft 16. An accommodating chamber 51 is defined at the rear portion of the central bore 26. A cylindrical radial bearing 27 is arranged in the central bore 26 to support the rear end of the drive shaft 16.

The crank chamber 15 and the suction chamber 38 are connected to each other by the bleeding passage 47. The bleeding passage 47 includes a communication conduit 16*c*, which extends through the drive shaft 16 along the axis L, the accommodating chamber 51, and a pressure releasing hole 14*b*, which extends through the center of the valve plate 14. The front end of the communication passage 16*c* is connected with the crank chamber 15 near the radial bearing 20. In the accommodating chamber 51, an end bearing 71 and a shaft spring 72 are arranged between the rear end of the drive shaft 16 and the valve plate 14.

The bleeding passage 47 is closed by the valve V, which is formed in the accommodating chamber 51. A valve hole 73, which is connected to the communication conduit 16*c*, extends through the rear portion of the drive shaft 16. The rear portion of the communication conduit 16*c* is sealed by a plug 74. A valve body 75 is movably inserted into the valve hole 73. A spring 76 urges the valve body 75 in a direction opening the valve hole 73.

A counterweight 77 is attached to the valve body 75 on the other side of the drive shaft 16. When the rotating speed N of the drive shaft 16 exceeds the limit value Nc, the centrifugal force applied to the counterweight 77 moves the counterweight 77 radially. This moves the valve body 75 against the force of the spring 76 and closes the valve hole 73. In this state, the flow of refrigerant gas in the bleeding passage 47 from the crank chamber 15 to the suction chamber 38 is stopped.

The force of the spring 76 keeps the bleeding passage 47 opened by the valve body 75 as long as the rotating speed N of the drive shaft 16 remains lower than the limit value Nc. Accordingly, the valve V opens and closes the bleeding passage 47 in accordance with the rotating speed N of the drive shaft 16 with a simple structure.

The swash plate 21 has a hinge portion 25, which is an off-center mass. The counterweight 77 is located on the opposite side of the drive shaft 16 from the hinge portion 25. In other words, the angular interval, as measured about the drive shaft 16, between the counterweight 77 and the hinge portion 25 is 180°. Therefore, the counterweight 77 balances the weight of the hinge portion 25 and causes the drive shaft 16 to rotate without vibrations.

The accommodating chamber 51, which is included in the central bore 26, is located behind the axis L of the drive shaft 16. Furthermore, the central bore 26 is used to receive the rear end of the drive shaft 16 and the radial bearing 27, which is an ordinary cylindrical bearing that is arranged between the wall of the central bore 26 and the drive shaft 16. Therefore, the radial dimension of the cylinder block 12 may be decreased in comparison to when using roller bearings, such as needle bearings.

In addition, the gap between the drive shaft 16 and the wall of the central bore 26 can be narrowed. This decreases the amount of the refrigerant gas in the crank chamber 15 that is sent to the accommodating chamber 51 and the suction chamber 38 through the gap. Thus, when the valve V is closed, the pressure of the crank chamber 15 is increased at a gradual rate. In other words, a sudden increase in the pressure of the crank chamber 15 is prevented.

It should be apparent to those skilled in the art that the present invention may be embodied in many other specific forms without departing from the spirit or scope of the invention.

In each of the above embodiments, the minimum displacement may be set within a range of 30% to 60% of the maximum displacement.

In each of the above embodiments, a rod arranged between the rotor 19 and the swash plate 21 may be employed in lieu of the snap ring 23 to restrict the inclination of the swash plate 21. In such case, the inclination of the swash plate 21 corresponding to the minimum displacement state is adjusted during assembly of the compressor.

In each of the above embodiments, the opposing guide surfaces 53*a*, 57*a*, 14*b* (16*b*, 62*a* in the second embodiment) may both be conical surfaces.

In the second and fifth embodiments, the rotated guide surface 16*b* (57*a* in the fifth embodiment) is conical. However, the fixed guide surface 62*a* (14*b*) of the valve body 62 may be conical instead such that its diameter increases at positions closer to the rotated guide surface 16*a* (57*a*).

In each of the above embodiments, the number of orbiting balls 59 may be more than or less than five.

In each of the above embodiments, the guides and the orbiting balls function as thrust ball bearings. However, the balls may be replaced by other types of orbiting elements, such as cylindrical needles or rollers that function as a roller-type bearing.

In the first and third to sixth embodiments, a displacement control valve may be arranged in the bleeding passage 47 to adjust the opened size of the bleeding passage 47 and change the pressure of the crank chamber 15.

In the second and seventh embodiments, the displacement control valve may be arranged in the supply passage 48 to adjust the opened size of the supply passage 48 and changed the pressure of the crank chamber 15.

In each of the above embodiments, the supply passage 48 and the displacement control valve 49 may be eliminated. In such compressor, the compressor is operated in a maximum displacement state under normal conditions, and the valve V shifts the displacement from maximum to minimum during acceleration of the vehicle.

Therefore, the present examples and embodiments are to be considered as illustrative and not restrictive, and the invention is not to be limited to the details given herein, but may be modified within the scope and equivalence of the appended claims.

What is claimed is:

1. A variable displacement compressor comprising:

a drive shaft rotated about its axis;

a compression mechanism for drawing in and compressing gas in accordance with the rotation of the drive shaft, wherein the compression mechanism includes a drive plate supported on the drive shaft, wherein the drive plate inclines between a maximum inclination position, at which the displacement of the compressor is maximum, and a minimum inclination position, at which the compressor displacement is minimum;

a crank chamber housing part of the compression mechanism, wherein the gas flows into and out of the crank chamber to vary the displacement in accordance with the pressure of the gas in the crank chamber, the inclination of the drive plate being decreased as the pressure of the crank chamber increases;

a suction pressure region, which is exposed to the gas drawn into the compressor by the compression mechanism;

a discharge pressure region, which is exposed to the gas compressed by the compression mechanism;

a first passage that increases the pressure of the crank chamber by permitting the flow of the gas from the discharge pressure region to the crank chamber;

a second passage that decreases the pressure of the crank chamber by permitting the flow of the gas from the crank chamber to the suction pressure region;

a valve arranged to open and close a port, which is in one of the first passage and the second passage, the valve having centrifugal force adjustment means for adjusting opening and closing of the port in response to a centrifugal force produced by the rotation of the drive shaft, wherein the valve adjusts the opened area of the port to increase the pressure of the crank chamber when the rotating speed of the drive shaft exceeds a predetermined value; and a stopper engagable with the drive plate for regulating the minimum inclination position of the drive plate such that the minimum displacement is about 30% to 60% of the maximum displacement, wherein the drive plate contacts the stopper when in the minimum inclination position.

2. The variable displacement compressor according to claim 1, wherein the stopper regulates the minimum inclination position of the drive plate such that the minimum displacement is about 50% of the maximum displacement.

3. The variable displacement compressor according to claim 1, wherein the stopper comprises a snap ring fitted on the drive shaft.

4. The variable displacement compressor according to claim 1, wherein the valve is located in the first passage to open the first passage when the rotating speed of the drive shaft exceeds the predetermined value.

5. The variable displacement compressor according to claim 1, wherein the valve is located in the second passage to close the second passage when the rotating speed of the drive shaft exceeds the predetermined value.

6. The variable displacement compressor according to claim 1, wherein the valve includes:

a valve body for selectively opening and closing the port; and orbiting elements following the rotation of the drive shaft to orbit about the longitudinal axis of the drive shaft and act on the valve body to selectively open and close the port, the orbiting elements maintaining substantially equal angular intervals between one another when orbiting about the longitudinal axis of the drive shaft, each orbiting element having an orbiting radius defined by the path of the orbiting elements about the longitudinal axis of the drive shaft, the orbiting elements moving radially to change the orbiting radius in accordance with the rotating speed of the drive shaft.

7. The variable displacement compressor according to claim 6 further comprising:

a first guide rotated integrally with the drive shaft, wherein the first guide has a surface to guide the orbiting of the orbiting elements;

a second guide having a surface facing the rotating guide surface to guide the orbiting elements; and an urging member for urging one of the first and second guides toward the other, the orbiting elements being arranged between the first and second guides and orbited about the axis of the first guide by the rotation of the first guide, the orbiting radius of the orbiting elements being changed in accordance with centrifugal force produced by the motion of the orbiting elements, which counters the force of the urging member.

8. The variable displacement compressor according to claim 7, wherein the port extends axially through the second guide.

9. The variable displacement compressor according to claim 7, wherein the second guide is movable in the axial direction of the first guide and functions as the valve body, and wherein the urging member urges the second guide toward the first guide.

10. The variable displacement compressor according to claim 7, wherein at least one of the first and second guide surfaces is substantially conical.

11. The variable displacement compressor according to claim 6, wherein the orbiting elements are spherical bodies.

12. The variable displacement compressor according to claim 6, wherein the valve body has a spherical surface, and wherein the spherical surface of the valve body is in contact with each orbiting element.

13. The variable displacement compressor according to claim 8, wherein the orbiting elements and the valve body are identical spherical bodies.

14. The variable displacement compressor according to claim 8, wherein the valve body is arranged in the first passage to move in a direction increasing the opened area of the first passage to increase the pressure of the crank chamber, the valve body functioning as a differential pressure sensor actuated by the difference between the pressure of the discharge pressure region and the pressure of the crank pressure region, wherein the valve body opens the first passage when the differential pressure exceeds a variable limit value, the variable limit value being decreased as the rotating speed of the drive shaft increases.

15. The variable displacement compressor according to claim 1, wherein the valve is located at the rear end of the drive shaft.

16. The variable displacement compressor according to claim 1, wherein the second passage includes a conduit extending through the axis of the drive shaft.

17. The variable displacement compressor according to claim 1, wherein the valve includes a valve body for opening and closing the second passage, a spring for urging the valve body in a direction opening the second passage, and a counterweight for moving the valve body against the force of the spring in a direction closing the second passage when the rotating speed of the drive shaft exceeds the predetermined value.

18. The variable displacement compressor according to claim 17, wherein the valve body has two ends and is inserted radially through the drive shaft, the counterweight being arranged on one end of the valve body and the other end of the valve body being movable against the urging of the spring to close the second passage.

19. The variable displacement compressor according to claim 18, wherein the drive plate includes an off-center hinge portion, and wherein the counterweight and the hinge portion are located on opposite sides of the drive shaft.

20. The variable displacement compressor according to claim 1, wherein the valve has an orbiting element that follows the rotation of the drive shaft to orbit about the axis of the drive shaft and act on the valve to selectively open and close the port, wherein the orbiting element has an orbiting radius defined by the path of the orbiting element about the axis of the drive shaft, and wherein the orbiting element moves radially to change the orbiting radius in accordance with the rotating speed of the drive shaft.

* * * * *